US009616275B1

(12) United States Patent
Rogoff et al.

(10) Patent No.: US 9,616,275 B1
(45) Date of Patent: Apr. 11, 2017

(54) ANKLE STRENGTHENING EXERCISE DEVICE

(71) Applicants: St. Joseph Health System, Irvine, CA (US); Innovation Lab, LLC, Newport Beach, CA (US)

(72) Inventors: Scott Rogoff, Fullerton, CA (US); Thomas Graham, Cleveland, OH (US); Marc Habib, Redondo Beach, CA (US); Ryan Kelly, Tustin, CA (US)

(73) Assignees: ST. JOSEPH HEALTH SYSTEM, Irvine, CA (US); INNOVATION LAB, LLC, Newport Beach, CA (US)

( * ) Notice: Subject to any disclaimer, the term of this patent is extended or adjusted under 35 U.S.C. 154(b) by 61 days.

(21) Appl. No.: 14/749,550

(22) Filed: Jun. 24, 2015

Related U.S. Application Data

(63) Continuation-in-part of application No. 13/730,567, filed on Dec. 28, 2012.

(51) Int. Cl.

| | |
|---|---|
| ***A63B 23/08*** | (2006.01) |
| ***A63B 21/055*** | (2006.01) |
| ***A63B 21/00*** | (2006.01) |
| ***A63B 26/00*** | (2006.01) |
| ***A63B 23/00*** | (2006.01) |

(52) U.S. Cl.
CPC ..... *A63B 21/1484* (2013.01); *A63B 21/0552* (2013.01); *A63B 23/00* (2013.01); *A63B 23/08* (2013.01); *A63B 26/003* (2013.01); *A63B 2023/003* (2013.01)

(58) Field of Classification Search
CPC ..... A63B 21/0552; A63B 21/0442; A63B 23/03541; A63B 23/08; A63B 21/0557; A63B 21/143
USPC ..... 482/51, 69, 79–80, 92, 142, 143, 146, 482/148, 907–908; 602/32–33; 606/241; 601/5, 27–35
See application file for complete search history.

(56) References Cited

U.S. PATENT DOCUMENTS

| | | | |
|---|---|---|---|
| 1,399,606 | A | 12/1921 | Salvatore |
| 2,760,774 | A | 8/1956 | Perez |
| 4,733,859 | A | 3/1988 | Kock et al. |
| 4,848,325 | A | 7/1989 | Lillie |
| 5,100,129 | A | 3/1992 | Porter |

(Continued)

OTHER PUBLICATIONS

Neurogym Technologies, Movement-Enabling Equipment, Ankle Trainer http://www.neurogymtech.com/products/ankle-trainer/.

(Continued)

*Primary Examiner* — Andrew S Lo
(74) *Attorney, Agent, or Firm* — Stetina Brunda Garred and Brucker

(57) ABSTRACT

An ankle strengthening and rehabilitation exercise device is disclosed. The device is intuitive and simple to use by a patient even without professional medical supervision since the device indicates a specific movement of a foot by pivoting an ankle of the patient. In particular, the device may have an extension member that can be positioned on a frame of the device. The foot of the patient may engage the device. An elastic member may be secured to the extension member and the foot. The direction of the elastic member indicates the direction the foot of the patient should move by pivoting his or her ankle to specifically work or strengthen and exercise a particular ankle muscle of the patient.

20 Claims, 21 Drawing Sheets

(56) References Cited

U.S. PATENT DOCUMENTS

| | | | | |
|---|---|---|---|---|
| 5,186,698 | A | 2/1993 | Mason et al. | |
| 5,303,716 | A | 4/1994 | Mason et al. | |
| 5,509,894 | A | 4/1996 | Mason et al. | |
| 5,582,579 | A | 12/1996 | Chism et al. | |
| 5,593,374 | A | 1/1997 | Gvoich | |
| 5,645,516 | A | 7/1997 | Foster | |
| 5,704,881 | A | 1/1998 | Dudley | |
| 5,836,857 | A | 11/1998 | Jennings | |
| 5,897,474 | A * | 4/1999 | Romero | A63B 22/14 446/396 |
| 6,063,013 | A | 5/2000 | Vathappallil | |
| 6,283,897 | B1 | 9/2001 | Patton | |
| 6,390,957 | B1 | 5/2002 | Knight | |
| 6,592,502 | B1 | 7/2003 | Phillips | |
| 6,821,235 | B1 * | 11/2004 | Johnson | A63B 21/0552 482/146 |
| 6,942,604 | B2 | 9/2005 | Teff | |
| 7,192,410 | B1 | 3/2007 | Rodgers | |
| 7,322,914 | B1 | 1/2008 | Vittone et al. | |
| 7,794,367 | B2 | 9/2010 | Hall et al. | |
| 8,083,654 | B1 | 12/2011 | MacDonald et al. | |
| 8,142,336 | B1 | 3/2012 | Yates | |
| 8,202,205 | B2 | 6/2012 | Reade | |
| 8,434,824 | B2 | 5/2013 | Spinabella et al. | |
| 8,622,880 | B1 | 1/2014 | Collett | |
| 2003/0148865 | A1 * | 8/2003 | Handshoe | A63B 22/18 482/148 |
| 2004/0009850 | A1 * | 1/2004 | Teff | A63B 21/0552 482/79 |
| 2005/0043150 | A1 | 2/2005 | Nitta et al. | |
| 2005/0209073 | A1 * | 9/2005 | Chen | A63B 21/0004 482/146 |
| 2006/0167397 | A1 | 7/2006 | Walsh | |
| 2006/0178607 | A1 | 8/2006 | Evans | |
| 2007/0054791 | A1 * | 3/2007 | Langer | A63B 21/0004 482/146 |
| 2007/0191193 | A1 | 8/2007 | Backes | |
| 2007/0232449 | A1 | 10/2007 | Planke | |
| 2007/0249971 | A1 | 10/2007 | Doran | |
| 2008/0255491 | A1 | 10/2008 | Scott | |
| 2009/0227929 | A1 | 9/2009 | Gondringer | |
| 2009/0270231 | A1 | 10/2009 | Hall et al. | |
| 2010/0261583 | A1 | 10/2010 | Ferguson et al. | |
| 2011/0071441 | A1 | 3/2011 | Rodgers | |
| 2013/0123077 | A1 * | 5/2013 | Dunegan | A63B 21/0552 482/139 |
| 2013/0197403 | A1 | 8/2013 | Sevy et al. | |
| 2013/0211297 | A1 | 8/2013 | Method | |
| 2014/0087927 | A1 * | 3/2014 | Richard | A63B 71/0036 482/123 |
| 2014/0187388 | A1 | 7/2014 | Rogoff | |
| 2014/0371041 | A1 * | 12/2014 | Terpstra | A63B 22/18 482/146 |
| 2015/0190679 | A1 * | 7/2015 | Carbone | A63B 26/003 482/146 |
| 2015/0238793 | A1 * | 8/2015 | Kramer | A63C 17/0093 482/142 |

OTHER PUBLICATIONS

AskDoctorJo, "Ankle Strengthening Exercises & Stretches—Ask", YouTube (video), Retrieved from the Internet as early as Sep. 26, 2016, <URL:https://www.youtube.com/watch?v=g-iXYapbuqk&feature=youtu.be>.

* cited by examiner

ANKLE STRENGTHENING EXERCISE DEVICE

CROSS-REFERENCE TO RELATED APPLICATIONS

The present application is a continuation-in-part patent application of U.S. patent application Ser. No. 13/730,567, filed on Dec. 28, 2012, the entire contents of which are incorporated herein by reference.

STATEMENT RE: FEDERALLY SPONSORED RESEARCH/DEVELOPMENT

Not Applicable

BACKGROUND

The device and method disclosed herein relate to a physical therapy device.

Ankle injuries are common and may be a result of weak muscles associated with the ankle. During typical daily activities, or in association with sport related activities, one or more muscles in the ankle can give way to stresses or loads beyond their capacity due to associated weakness, which can lead to injury to the ankle/foot complex, neural tissue and supportive structures. While recovering from an ankle injury, the patient may be required to rest (i.e. not exercise) his or her ankle/foot to allow for necessary healing to take place, however, this rest period can allow for further weakening or atrophy of the surrounding ankle/foot muscles. As a result, many ankle/foot injuries require subsequent physical therapy to strengthen the muscles of the ankle/foot to help allow the patient to recover to a necessary functional level and to help prevent further injury from occurring again.

During physical therapy, the physical therapist evaluates the patient to assess the associated impairments of the joint and its supportive tissues (i.e. muscles). Based on the assessment, the physical therapist will develop a working diagnosis on what tissues or motions appear to be impaired, which will then lead to appropriate treatment of the surrounding joint and tissues—which may require strengthening. However, since it can be time consuming or expensive for the patient to work with the therapist multiple times per week, patients are often educated on how to perform exercises on their own at home without supervision. By way of example and not limitation, the physical therapist may teach the patient to tie an elastic member around his or her foot and tie the other end of the elastic member to a leg of a chair or weight or other stationary object. The patient must readjust his or her body in order to move his or her foot by pivoting his or her ankle in a particular manner in order to exercise and strengthen a particular muscle (or group of muscles) associated with the ankle. If the movement of the foot is slightly off, the muscle that needs to be strengthened is not activated correctly. Instead, a different muscle altogether is activated and strengthened. At home, the patient may not realize that he or she is performing the exercises incorrectly and strengthening the wrong muscle or group of muscles. Hence, defeating the purpose of the ankle exercise regimen.

Accordingly, there is a need in the art for an improvement for exercising an ankle of the patient.

BRIEF SUMMARY

The ankle strengthening exercise device disclosed herein addresses the needs discussed above, discussed below and those that are known in the art.

The ankle strengthening device may include a frame having a plurality of anchors distributed about the frame, an extension member that may be secured to any one of the plurality of anchors. An elastic member that may be secured to the extension member and a foot of the patient which rests on a cradle to properly position the foot with respect to the extension member. A direction indicated by the elastic member represents the direction of movement of the patient's foot should occur by pivoting the patient's ankle to exercise a particular muscle (or group of muscles) associated with the ankle. During movement of the ankle joint, the elastic member (attached to the foot) will provide resistance to specific ankle muscles based on the associated angular setup for which it has been designed and described by the therapist. Based on the specific directions and angular setup educated to the patient when using the device, he or she will have a much easier time strengthening each specific muscle(s) associated with their ankle. Any ankle movements that deviate from the simple and specific angles involved with the resistance band and extension member will make it apparent that the patient is incorrectly performing their ankle strengthening exercises. The elastic member should move primarily along its longitudinal axis during movement of the foot and rotation of the ankle. By way of example and not limitation, the elastic member should not move laterally more than 1 inch as the patient moves his or her foot in the direction indicated by the elastic member. In this manner, the patient is forced to work a particular muscle associated with his or her ankle. Any movement of the foot not in general alignment with the direction of the elastic member would work a different muscle or group of muscles.

More particularly, an ankle strengthening exercise device for strengthening one or more muscles associated with an ankle/foot is disclosed. The device may comprise a frame, a leg cradle, an extension member and an elastic member. The frame may have a plurality of anchors. The leg cradle is selectively positionable at various elevations on the frame and at various angles. The extension member may be secured to one of the plurality of anchors so that a distal end portion of the extension is positioned laterally, at a skewed angle, or in front of the frame. The distal end portion of the extension member may have a hook or eyelet.

The elastic member may define first and second opposed end portions. The first end portion may be secured to a patient's foot. The second end portion of the elastic member may be removably secured to the hook or eyelet of the extension member.

A direction of the elastic member indicates a direction that a foot of the patient should make by pivoting an ankle of the patient to exercise and strengthen a particular muscle or group of muscles associated with the ankle.

The frame may comprise first and second upright members. Each of the upright members may have first and second sides. The first sides may have a slot for sliding the leg cradle up and down to vertically position the leg cradle. The second sides may have a plurality of anchors vertically positioned on the second sides for positioning the elastic member.

The slots of the first sides may be in alignment with each other so that the leg cradle may be positioned at various elevations on the frame and oriented at various angles.

The device may further comprise a plurality of extension members. Each extension member may have a different length and/or shape. The extension member may be straight or S shaped.

In another aspect, a method of instructing a patient to exercise and strengthen a muscle or group of muscles associated with an ankle/foot of a patient without supervision is disclosed. The method may comprise the steps of setting a vertical and/or angular positions of a cradle on a frame of an ankle exercise device; securing an extension member to an anchor of the frame; securing an elongate elastic member to the extension member and a foot of the patient to provide resistance during an ankle exercise and indicate a direction of foot movement during the ankle exercise; and instructing the patient to move his/her foot by pivoting his/her ankle in the direction of the elongate elastic member.

The method may further comprise the step of recording a vertical position of the cradle, an angular orientation of the cradle, a particular anchor from a plurality of anchors to which the extension member is to be secured.

In another aspect, a method of exercising and strengthening a muscle or group of muscles associated with an ankle is disclosed. The method may comprise the steps of setting up vertical and/or angular positions of a cradle on a frame of an ankle exercise device; securing an extension member to an anchor of the frame; securing an elongate elastic member to the extension member and a foot of the patient to provide resistance during an ankle exercise and indicate a direction of foot movement during the ankle exercise; and moving a foot by pivoting an ankle in the direction of the elongate elastic member.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
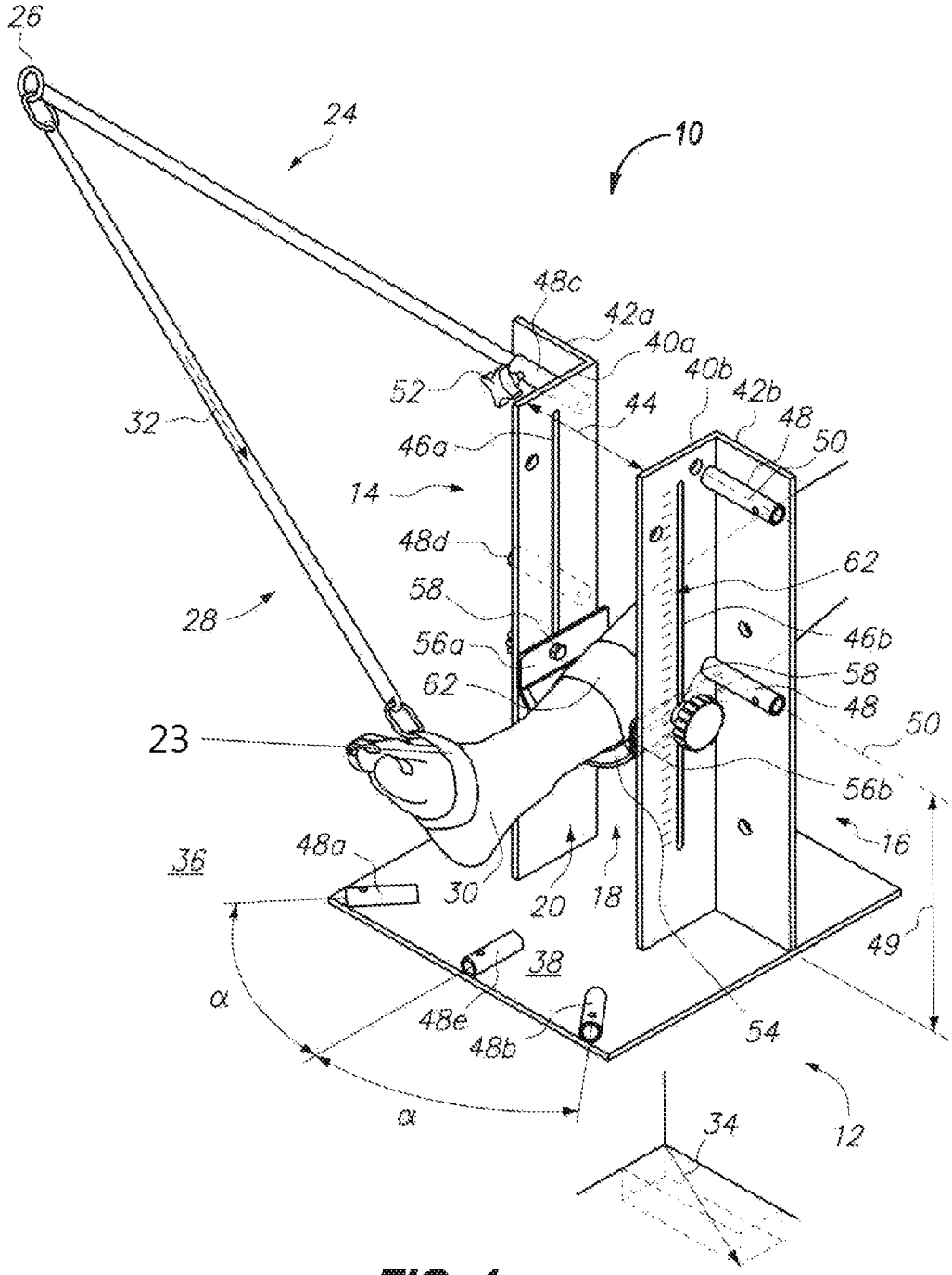
FIG. 1 is a perspective view of an ankle strengthening exercise device with a foot of the patient set up for exercising a right tibialis posterior muscle.

Referring now to the drawings, an ankle strengthening exercise device 10 is shown. The device 10 includes a base 12 and first and second upright members 14, 16. The upright members 14, 16 may support an adjustable cradle 18 for supporting the lower leg 20 of the patient 22. An extension member 24 may be attached to the first or second upright members 14, 16 or the base 12. The distal end of the extension member 24 may have a hook (or eyelet) 26. An elastic band 28 may be secured to the hook (or eyelet) 26 of the extension member 24 and a cuff attached to a foot 30 of the patient 22 in order to activate and strengthen a specific muscle (or group of muscles) of the ankle of the patient 22. The angular orientation of the band 28 indicates a direction 32 in which the patient's foot 30 by pivoting the ankle should move to exercise a specific muscle (or group of muscles). The patient 22 pivots his or her foot 30 in alignment with the direction 32 of the band 28. The direction 32 of the band 28 is shown by arrow 32. The direction 34 of the patient's foot movement is shown by arrow 34. The device 10 is intuitive in that the patient 22 is instructed to move his or her foot 30 in line with the direction 32 of the band 28 by pivoting his or her ankle. By doing so, the device 10 targets a specific muscle or group of muscles for which the device 10 has been set up. Any other motion of the ankle moving the foot 30 out of alignment with direction 32 of the band may exercise a different muscle or group of muscles and defeat the specific physical therapy program designed for the patient 22. The patient 22 is exercising the wrong muscle or group of muscles. Fortunately, the device 10 visually indicates the proper direction the foot 30 should move in via specific ankle motion, in order to effectively activate and strengthen the correct ankle/foot muscle or group of muscles.

More particularly, the device 10 includes the base 12. The base 12 may be flat and provide support for the first and second upright members 14, 60. The base 12 enables the device 10 to be supported on a flat support surface 36 (e.g., ground, tabletop, bed, raised surface). The base 12 may define an upper surface 38 and a lower surface (not shown) which rests on the flat support surface 36.

The first and second upright members 14, 16 may be secured to the upper surface 38 of the base 12. The first and second upright members may each have an angle configuration defining first and second plates 40*a, b*, 42*a, b*. The first plates 40*a, b* may be oriented parallel to each other. These first plates 40*a, b* may be gapped apart by distance 44. The distance 44 may be wider than the leg 20 of the patient so that the patient's leg 20 may be disposed therebetween. The first plates 40*a, b* may additionally have slots 46*a, b*. The slots 46*a, b* may be formed perpendicular to the upper surface 38 of the base 12 and be in alignment with each other.

The second plates 42*a, b* of the first and second upright members 14, 16 may be oriented perpendicular to the first plates 40*a, b*. The second plates 42*a, b* may additionally have a plurality of anchors 48. These anchors 48 may be placed at various heights 49 on the second plates 42*a, b*. Preferably, for each anchor 48 on the second plate 42*a* of the first upright member 14, a corresponding anchor 48 is mounted to the second plates 42*d* of the second upright member 16. The drawings illustrate two anchors 48 on each of the second plates 42*a, b* However, one or more anchors 48 may be mounted to the second plates 42*a, b* of the first and second upright members 14, 16. The anchors 48 may have a tubular construction with an open end oriented laterally outward. The anchors 48 may each define a central axis 50 that is parallel to the upper surface 38 of the base 12. The anchors 48 may additionally have a threaded hole that receives a set screw with an adjustment knob 52.

Anchors 48 may also be formed or mounted to the upper surface 38 of the base 12. Anchor 48*a* may extend out at an angle $\alpha$ of 45° from a central plane of the device 10 bisecting the device 10. It is also contemplated that the angle $\alpha$ may be between 15° and 75°. Additionally, anchor 48*b* on the other side of the base 12 may extend out at an angle $\alpha$ from the central plane of the device 10. The central axis 50 of anchors 48*a*, 48*b* and any other anchors 48 formed on the upper surface 38 of the base 12 may also be parallel to the upper surface 38 of the base 12. In this disclosure, the central axis 50 of the anchors 48 is described and shown as being parallel to the upper surface 38. However, in certain instances, the upper surface 38 may have a configuration other than flat. In these instances, the central axis 50 of the anchors 48 may be generally parallel to the support surface 36 upon which the device 10 is designed to rest.

The cradle 18 may be disposed between the first plates 40*a, b* of the first and second upright members 14, 16. The cradle 18 may have a concave configuration so that the cradle 18 may support the patient's lower leg 21 when placed thereon. Padding 54 may be secured to the upper surface of the cradle 18 to provide comfort to the patient 22 as the patient 22 performs his or her ankle exercises. Opposed distal end portions 56*a, b* of the cradle 18 may be flat and parallel with each other. The opposed distal end portions 56*a, b* may be parallel to the first plates 40*a, b* of the first and second upright members 14, 16. The opposed distal end portions 56*a, b* may have a threaded post 58 attached thereto and receivable into the slot 46*a, b* formed in the first plates 48*a, b* of the first and second upright members 14, 16. A nut with a handle may be mounted to the threaded post 58 to position the cradle 18 on the first plates 40*a, b*. As discussed above, the slots 46*a, b* are in alignment. Moreover, the threaded post 58 attached to the opposed distal end portions 56*a, b* are also aligned about a common axis. As such, the cradle 18 can be set at any vertical position along the slot 46*a, b*. The posts 58 can slide within the slots 46*a, b*. Also, the cradle 18 can be rotated about the common axis of the posts 58. Once the vertical position and the angular orientation of the cradle 18 are positioned in the optimal position, the adjustable knobs may be tightened onto the threaded posts 58. The lateral sides of the first plates 40*a, b* may additionally have graduation marks 62 so that the patient 22 can vertically position the cradle 18 at the same position when needed each time he or she is performing a particular exercise.

The extension member 24 may be removably attached to one of the anchors 48, as shown in FIGS. 1 and 3-5. In FIG. 1, the extension member 24 is attached to the anchor 48*c*. However, the extension member 24 may be secured to any one of the other anchors 48. The extension member 24 is shown as having a straight elongate rod configuration. The first distal end of the extension member 24 may be inserted into the open end of the anchor 48. To secure the extension member 24 to the anchor 48, the anchor 48 may have a threaded through hole which receives a set screw 52 having an adjustment knob. Once the extension member 24 is inserted into the anchor 48, the patient 22 may tighten the set screw 52 with the adjustment knob to prevent the extension member 24 from pulling out or detaching from the anchor 48 while the patient 22 exercises his or her ankle. The opposed second distal end of the extension member 24 may be formed with a hook or eyelet 26. The hook or eyelet 26 is shown as being an eyelet. However, other configurations are also contemplated.

Figure 5:
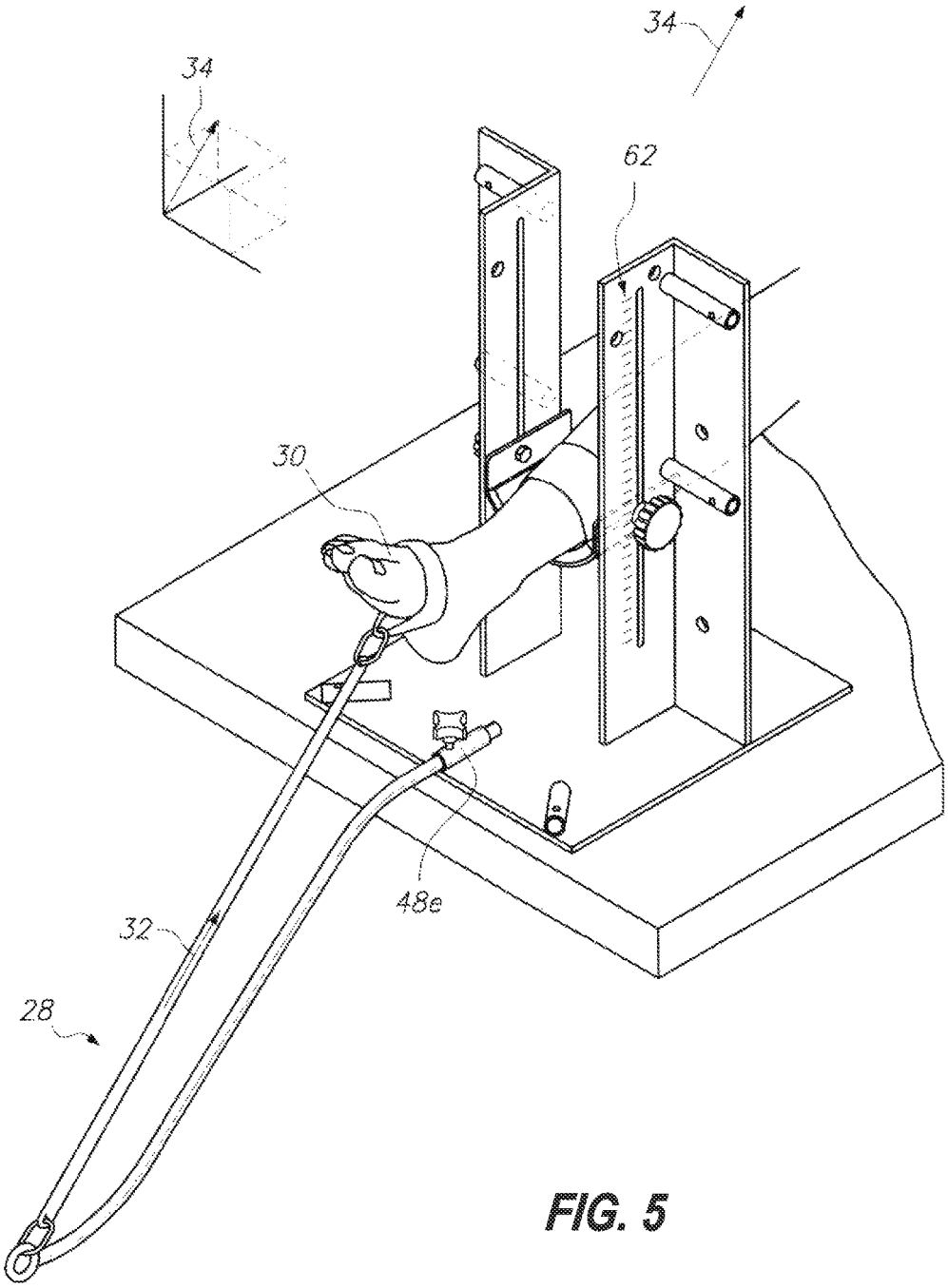
FIG. 5 is a perspective view of the ankle strengthening device shown in FIG. 1 with an extension member having an S-shaped configuration.

Additionally, although the extension member 24 is shown as having a straight elongate rod configuration, other configurations are also contemplated. By way of example and not limitation, the extension member 24 may be shorter or longer than shown. Additionally, the extension member 24 may have a curved S shape, as shown in FIG. 5.

Figure 2:
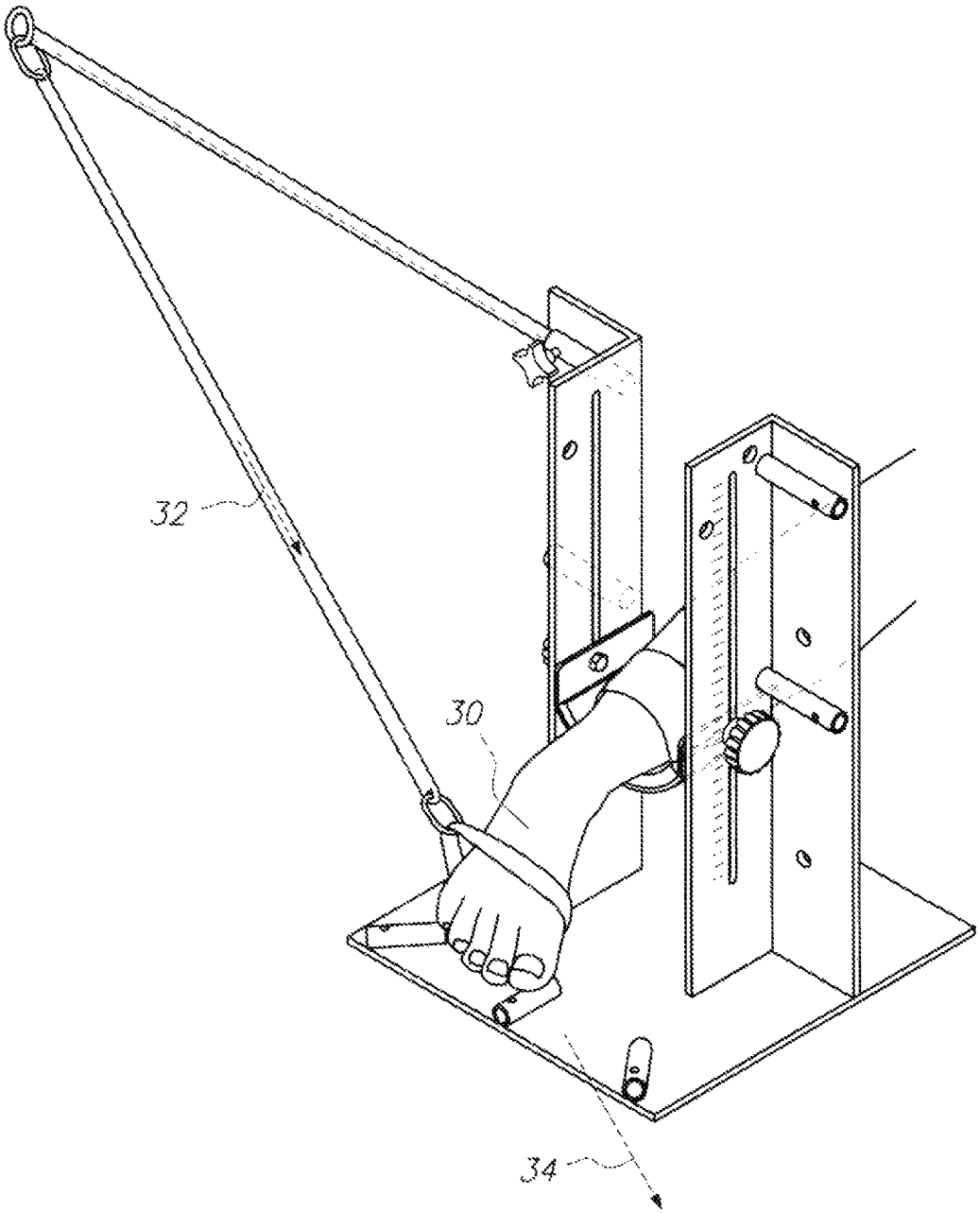
FIG. 2 is a perspective view of the ankle strengthening device shown in FIG. 1 with the foot of the patient moving his or her foot by pivoting his or her ankle in a direction in alignment with a direction indicated by an elastic member.

Referring now to FIGS. 1 and 2, the device 10 is shown as being set up for a patient 22 to activate or strengthen his or her right tibialis posterior muscle which is located immediately behind (or posterior to) the tibia of the leg 20. To strengthen the right tibialis posterior muscle, the extension member 24 is inserted into the upper anchor 48*c* as shown in FIG. 1. When the exercise is to be performed while sitting on a chair, the cradle 18 is positioned below the seat portion of the chair and below the anchor 48*c*. The front to back angle of the cradle 18 is set so as to be comfortable to the patient 22 as he or she rests his or her lower leg 20 on the cradle 18.

The band 28 is secured to the hook or eyelet 26 of the extension member 24 and the foot 30 of the patient 22 with a strap 23. The patient 22 sits down on the chair and places his or her lower leg 20 on the cradle 18. A strap 62 is placed around the lower leg 20 and secured to the cradle 18 so that the patient's leg 20 is immobilized. As shown in FIG. 1, the band 28 is pointed downward as shown by arrow 32. This direction 32 is the same direction that the patient 22 must rotate his or her ankle and move his or her foot 30 to exercise or strengthen the right tibialis posterior muscle. The band 28 provides a visual aid to the patient 22 to indicate proper movement of the foot 30. After setting up the device 10, the band 28 provides a clear indication of the direction and movement expected of the patient's foot 30.

The purpose of providing the visual aid in conjunction with the device 10 is to allow the patient 22 to activate or strengthen a particular muscle or muscle group with minimal or no supervision by a physical therapist. The exercise can be performed at home. At a physical therapy or rehabilitation clinic, the patient 22 does not require constant supervision.

If the foot 30 is pivoted at another direction out of alignment with the direction 32 of the band 28, such movement may not activate or strengthen the proper muscle. In the example shown in FIGS. 1 and 2, if the foot 30 is moved upward, the muscle being activated or strengthened would be the tibialis anterior muscle which is located in the front (anteriorly) of the tibia thereby defeating the entire purpose of the activity to activate or strengthen the tibialis posterior muscle. Moreover, it is also contemplated that the device may be sold directly to people. The device may come with instructions and visual aids on how to set up and use the device to effectively target a specific ankle muscle or muscle group.

The extension member 24 may be secured to any one of the other anchors 48. Also it is contemplated that different size and shape extension members 24 may be secured to any one of the anchors 48 depending on the muscle or muscle group to be activated or strengthened. The position of the cradle 18 could also be adjusted. After setting up the extension member 24 and the position and angle of the cradle 18, the patient 22 may engage the device 10. When the band 28 is attached to the hook or eyelet 26 of the extension member 24 and the foot 30, the direction of the band 28 defines the motion expected of the foot 30 to exercise a particular muscle or muscle group.

A physical therapist may initially work with the patient 22 to diagnose or identify the patient's 22 physical impairment. After diagnosis, the physical therapist may set up the device 10 for the patient 22 by positioning the vertical position of the cradle 18 and its front to back angular position. The patient 22 may place his or her lower leg 20 on the cradle 18 and be strapped down to immobilize the leg 20. The patient 22 is instructed to move his or her foot 30 by pivoting the ankle in the direction 32 indicated by the band 28. Once the physical therapist determines that the patient 22 is properly conducting the proper motion to exercise a specific muscle or muscle group associated with the ankle/foot complex, the physical therapist may record the vertical height of the cradle 18 as indicated by the linear graduation marks on the first plates 40*a, b* of the first and second upright members 14, 16 and the front to back angular position of the cradle 18 as indicated by the angular graduation marks on the first plates 40*a, b* of the first and second upright members 14, 16. The physical therapist may determine that one or more ankle exercises are necessary. For each of the ankle exercises, the physical therapist may indicate the vertical position and angular position of the cradle 18, the type of extension member 24 and the particular anchor to which the extension member 24 should be attached. The patient 22 may conduct the exercises at home since the device 10 limits the variables that might cause the patient 22 to improperly conduct the ankle exercise and strengthen the wrong muscle or muscle group. Plus, the band 28 indicates the motion to be expected of the patient's foot 30.

Figure 6:
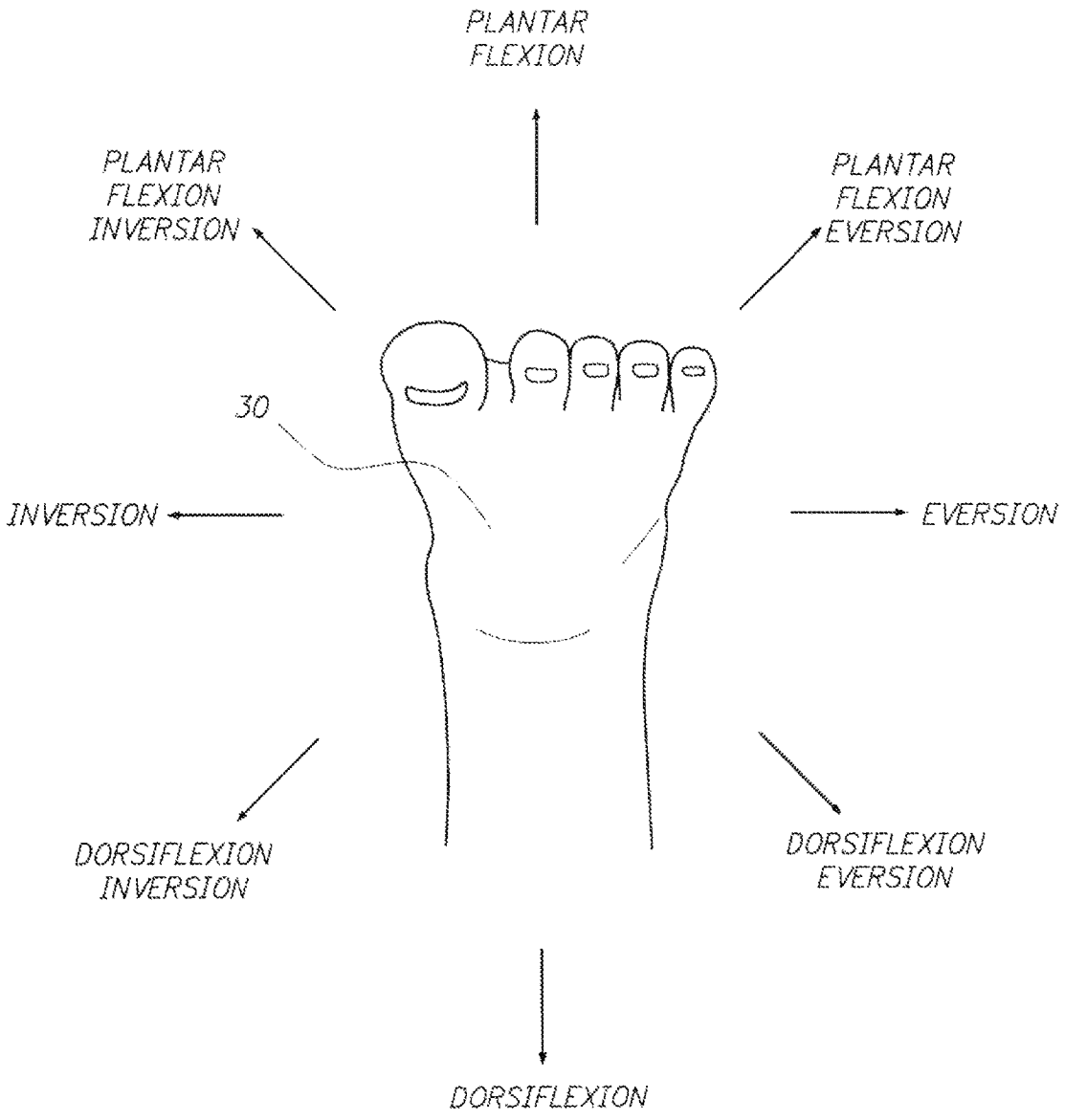
FIG. 6 is a top perspective view of a right foot and ankle illustrating various foot and ankle movements.

Referring now to FIG. 6, a top view of the patient's 22 right foot 30 is shown. To exercise a particular ankle muscle, the patient 22 must pivot his or her ankle so that the foot 30 performs one of the eight (8) movements identified and shown in FIG. 6. Please note that the ankle exercise shown in FIGS. 1 and 2 is ankle inversion with associated plantar flexion. Moreover, please note that there is an additional downward component of the foot movement necessary to activate and strengthen the tibialis posterior muscle. For a more horizontal inversion movement, the extension member 24 may be mounted to anchor 48*d* to bring the hook or eyelet 26 to the same elevation as the foot 30. In this instance, the direction 32 of the band 28 would not have a downward component. The patient 22 would merely shift the foot 30 horizontally (or medially) to perform the inversion motion.

Figure 3:
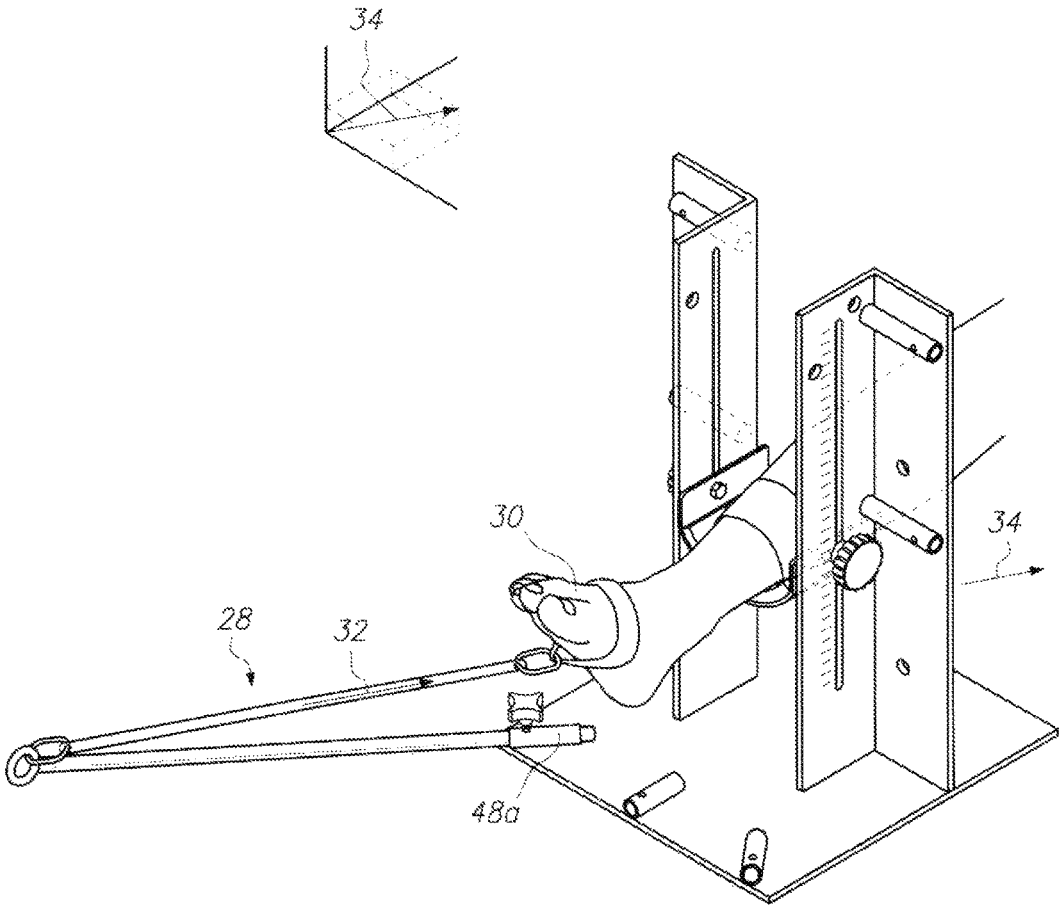
FIG. 3 is a perspective view of the ankle strengthening device shown in FIG. 1 with an extension member secured to a different anchor of the frame of the device.

Referring now to FIG. 3, the extension member 24 is mounted to the anchor 48*a*. When the elastic member is attached to the hook or eyelet 26 and the foot 30, the direction 32 of the band 28 indicates that the foot 30 should move in the dorsiflexion inversion direction shown in FIG. 6. There is also a slight upward component in that movement.

Figure 4:
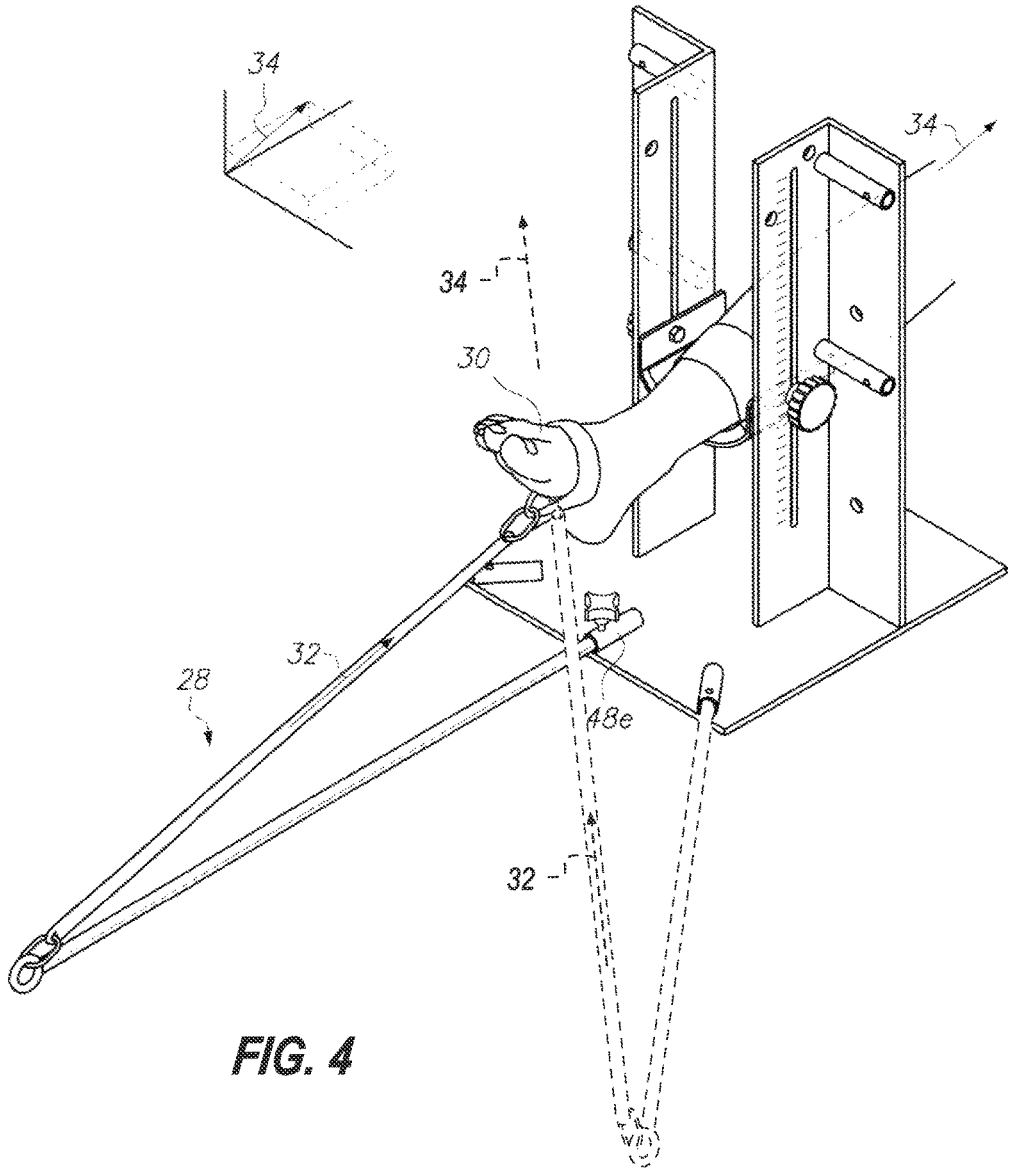
FIG. 4 is a perspective view of the ankle strengthening device shown in FIG. 1 with the extension member secured to a different anchor of the frame of the device.

Referring now to FIG. 4, the extension member 24 is attached to anchor 48*e*. The band 28 is attached to the hook or eyelet 26 and the foot 30 of the patient 22. The direction 32 of the band 28 indicates the dorsiflexion direction.

As discussed above, the extension member 24 may have other configurations. Referring to FIG. 5, the extension member 24 may have an S-shaped configuration. The S-shaped extension member 24 permits the user to obtain a particular direction 32 of the band 28 to exercise a particular ankle muscle of the patient 22.

Figure 7:
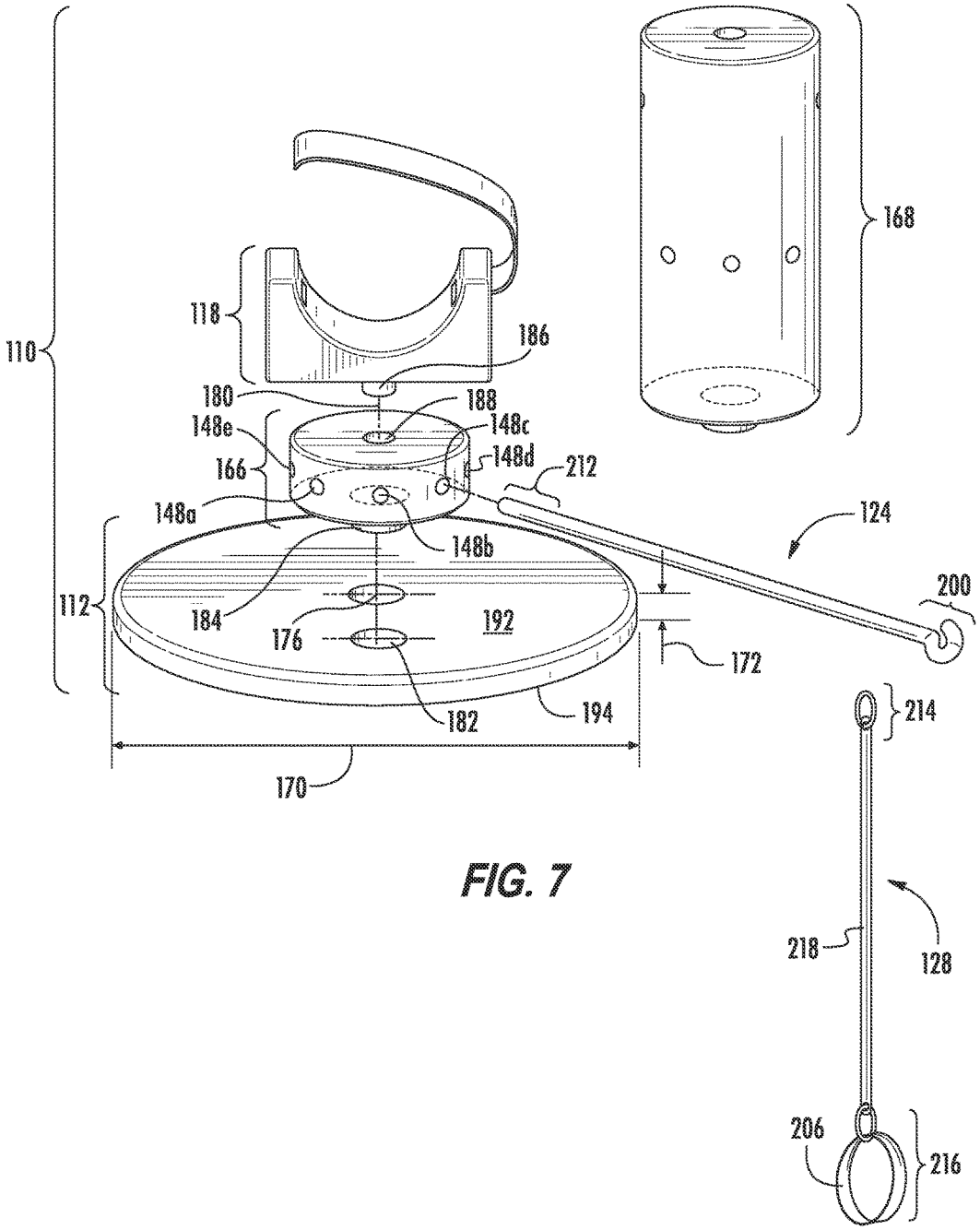
FIG. 7 is a perspective view of a second embodiment of the ankle strengthening exercise device.
Figure 7A:
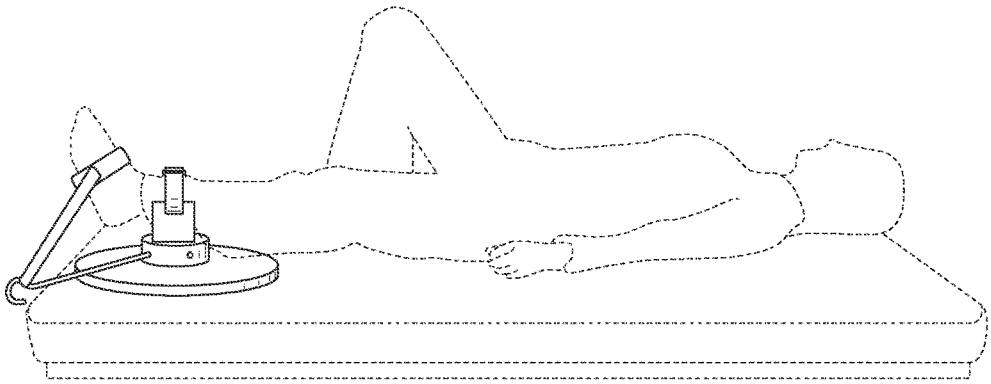
FIG. 7A illustrates the device shown in FIG. 7 being used while lying down.
Figure 8A:
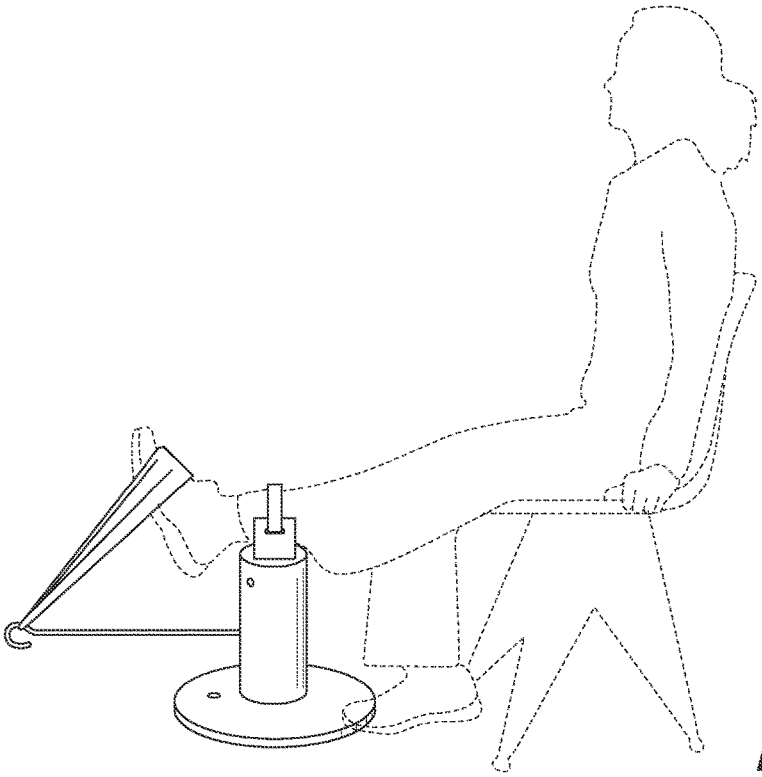
FIG. 8A illustrates the device shown in FIG. 8 being used while sitting in a chair.
Figure 8:
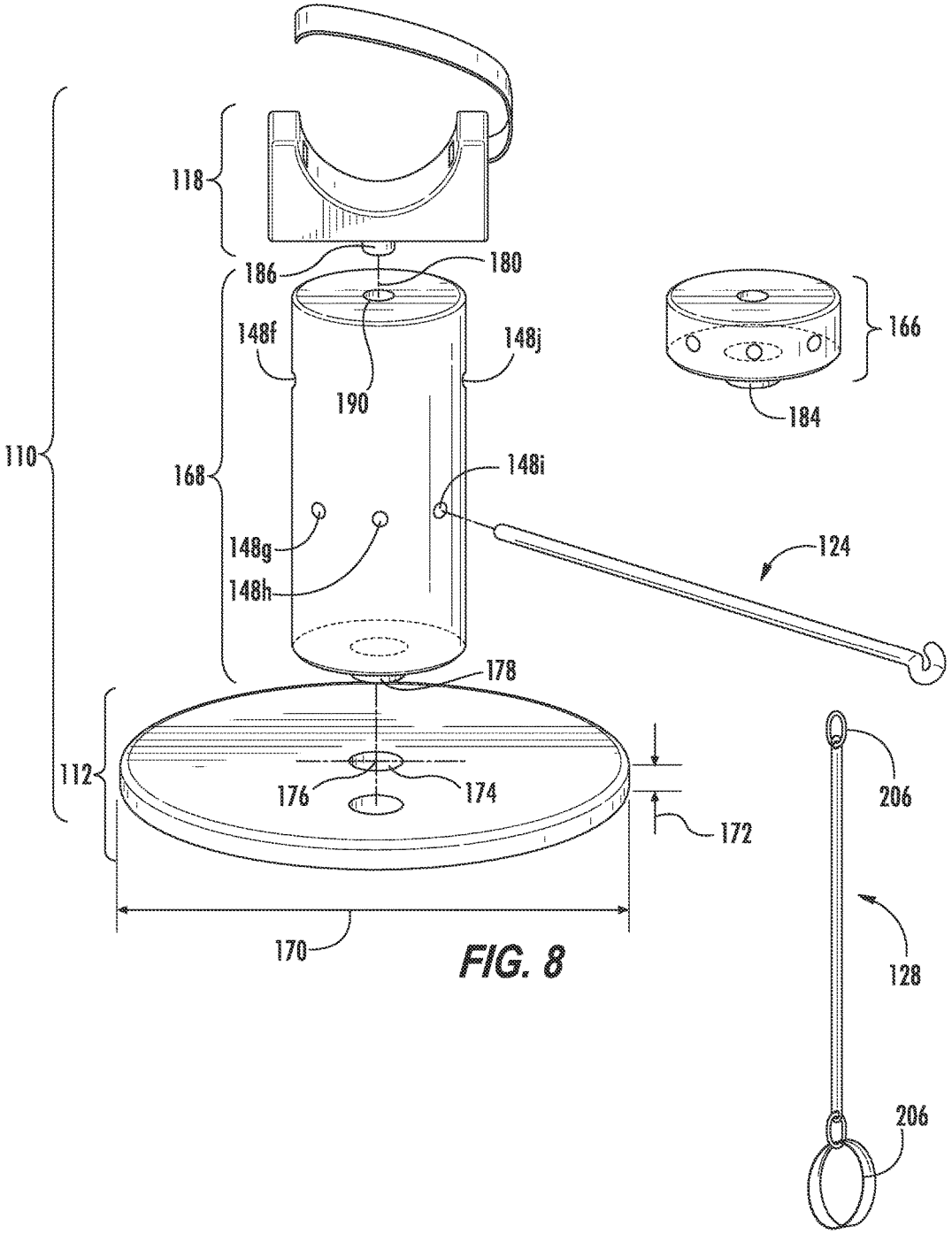
FIG. 8 is a perspective view of a third embodiment of the ankle strengthening exercise device.

Referring now to FIGS. 7 and 8, a second embodiment of the ankle strengthening exercise device 110 is shown. The ankle strengthening exercise device 110 may have a base 112, a short pedestal 166, a long pedestal 168, a cradle 118, an extension member 24 and an elastic band 128. The short and long pedestals 166, 168 may be removably attachable to the base 112 as shown in FIGS. 7 and 8. When the person is lying down such as on a treatment table (or bed, possibly), the short pedestal 166 may be used (see FIG. 7A), whereas, if the person is sitting down in a chair (see FIG. 8A), the long pedestal 168 may be used (see FIG. 8).

Figure 15:
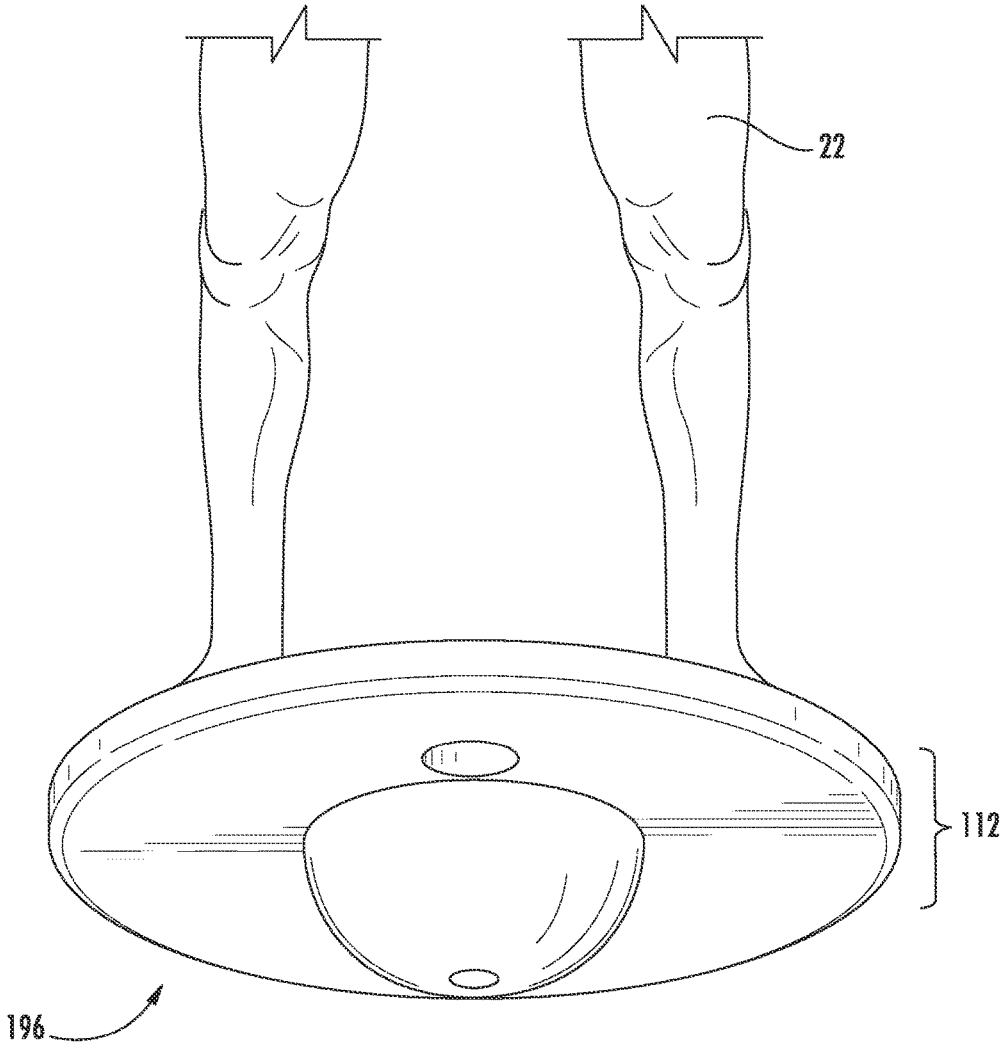
FIG. 15 illustrates the device shown in FIG. 14 being used as a proprioception board with both feet planted on the board.

The base 112 may be fabricated from a generally rigid material that does not flex significantly even when a person is standing on the base 112 (see FIG. 15). The base 112 may have a generally circular configuration. However, other configurations are also contemplated including but not limited to rectangular, triangular, polygonal and combinations thereof. The base 112 may have a diameter 170 between about 10 inches and about 40 inches and is preferably about 30 inches in diameter. The base 112 may also have a thickness 172 of about 1 inch but may be between about ½ inch to 3 inches thick 172. The base 112 additionally has a recess 174 located at a center 176 of the base 112. The recess 174 is preferably circular. However, other shapes are also contemplated including but not limited to polygonal, oval, etc. The recess 174 may have a depth sufficient to receive a protrusion 178 of the long pedestal 168 and support the pedestal 168. The recess 174 may proceed through the entire thickness 172 of the base 112 or portion thereof. The protrusion 178 of the long pedestal 168 and/or the recess 174 may be sized and configured to prevent any rotational movement of the long pedestal 168 about a vertical axis running through the center 176 of the recess 174. By way of example and not limitation, the recess 174 may be polygonal and the protrusion 178 of the long pedestal 168 may have a mating polygonal shape that is received into the polygonal shape of the recess 174. In this way, the polygonal configuration of the recess 174 and the protrusion 178 prevents rotational motion to occur between the two structures. If the recess 174 and the protrusion 178 of the long pedestal 168 are circular, then the recess 174 and the protrusion 178 may have a notch and key configuration which limits rotational movement of the long pedestal 168 about the vertical axis 180.

The same or different type of anti-rotation mechanism as that described in relation to the protrusion 178 of the long pedestal 168 and the recess 174 of the base 112 may be incorporated between a recess 182 (see FIG. 7) that receives a protrusion 184 of the short pedestal 166. Additionally, the same or different type of anti-rotation mechanism may be incorporated between a protrusion 186 of the cradle 118 and recesses 188, 190 of the short and long pedestals 166, 168.

Moreover, the base 112 may have parallel first and second surfaces 192, 194 which allow a person 22 to stand up on the base 112 to use the base 112 as a proprioception board 196, as shown in FIG. 15 and discussed below.

The extension member 124 may be straight, as shown in FIGS. 7-13. However, the extension member 124 may have other configurations such as S-shaped, L-shaped or other unique configurations in order to properly position the distal portion 200 in front, laterally, at a skewed angle or behind the cradle 118 so that the direction 32 of the band properly indicates a direction 34 in which the foot must be traversed to activate or strengthen a particular ankle muscle or muscle group. The extension member 124 has a proximal portion 212. The proximal portion 212 may be sized and configured to fit within the anchor 148*a, b, c, d, e* for the short pedestal 166 or the anchors 148*f-j* of the tall pedestal 168. In particular, the proximal portion 212 may be rounded with a blunt end in order to prevent hurting the patient or other people utilizing the device 110. The mating anchor 148 may have a corresponding configuration. The proximal portion 212 may also have a detent that holds the extension member 124 in the anchor 148 so that the extension member 124 does not fall out inadvertently during use and/or prevents rotational movement. Additionally and/or alternatively, the proximal portion 212 may be threaded with a matching mating thread on the interior of the mating anchor 148.

The extension member 124 may be fabricated from a generally rigid material so that the extension member 124 does not bend significantly so that the original direction 32 of the elastic band 128 which indicates the direction 34 in which the foot should be traversed to activate or strengthen a particular ankle muscle or muscle group does not change when the elastic band 128 is stretched. By way of example and not limitation, the extension member 124 may be fabricated from a metallic material such as steel, aluminum, titanium as well as non-metallic materials such as carbon fiber, plastic and other materials known in the art or developed in the future. The extension member 124 may have a hook configuration at the distal portion 200. The hook configuration of the distal portion 200 allows the user to hook a distal portion 214 of the elastic band 128 thereto 200. The hook configuration of the distal portion 200 of the extension member 124 is shown as being an open hook configuration. However, other hook configurations are also contemplated including but not limited to a carabineer or closed hook design.

The elastic band 128 may have a proximal portion 216 which has a band 206 which can be fitted over the person's foot during use of the device 110. The elastic band 128 may comprise one or more elastic members 218. In FIGS. 7-13, the elastic band 128 is shown as being a single elastic member 218. However, it is also contemplated that two or more elastic members 218 may be stacked in parallel to each other so that multiple proximal portions 214 of the elastic members 218 engages the distal portion 200 of the extension member 124. Similarly, multiple bands 206 of the elastic members 218 may be fitted over the foot of the user. The plurality of elastic members 218 defines the direction 32 in which the foot should be traversed in order to activate or strengthen the proper ankle muscle or muscle group.

Referring now to FIG. 7, the base 112 additionally has a second recess 182 for receiving the protrusion 184 of the short pedestal 166. The recess 182 may be positioned off-center from the center 176 of the base board 112. The recess 182 and the protrusion 184 may have an anti-rotation mechanism so that the short pedestal 166 does not rotate about the vertical axis 180 during use. By way of example and not limitation, the anti-rotation mechanism may be implemented in the form of configuring the recess 182 and the protrusion 184 to have mating polygonal shapes or the protrusion 184 and the recess 182 may have a notch and key system to prevent rotation of the short pedestal 166.

Referring now more particularly to the ankle strengthening exercise device 110 shown in FIG. 7, the short pedestal 166 is engaged to the front recess 182. Additionally, the cradle 118 is attached to the short pedestal 166. The short pedestal 166 may have five anchors 148*a, b, c, d, e*. These anchors 148*a-e* as well as anchors 148 *f-j* discussed below may also be referred to as fixation points. The anchors 148 *a-e* may be recesses, which fit a proximal end portion 212 of the extension member 124. The extension member 124 may be inserted into any one of the anchors 148*a-e*, and remain therein either through friction or other retaining mechanism (e.g., detent) or due to tension in the elastic band 128 when the patient is utilizing the ankle strengthening exercise device 110. The anchors 148*a-e* may be a circular hole that aligns the extension member 124 at unique angles in relationship to the first surface 192 of the base 112. By unique angles, directions can include, horizontal, or skewed upward or downward angles. By placing the lower leg of the patient 22 in a known position on the cradle 118 and the extension members 124 in any one of the five anchors 148*a-e*, the elastic member 128 which is attached to both a distal end portion 200 of the extension member 124 and the foot 204, the elastic member 128 indicates a direction 34 the foot 204 must be traversed in order to activate or strengthen a particular ankle muscle or muscle group.

The short pedestal 166 is used with the base 112 when the patient 22 is lying down on a treatment table (or bed, possibly), as shown in FIG. 7A. As such, the foot 204 of the patient 22 is pointed upward. If the extension member 124 is attached to the left anchor 148*a* and the left ankle is being exercised, then such setup would exercise the left fibularis muscle group (longus, brevis, tertius), as well as assistance from the tibialis anterior muscle by traversing the left foot 204 in the direction indicated by the direction 32 of the elastic band 128 so as to create tension in the elastic band 128. If the extension member 124 is attached to the middle anchor 148*b*, then such setup exercises the tibialis anterior and dorsiflexor group muscles when traversing the left or right foot 204 in the direction indicated by the elastic band 128 so as to create tension in the elastic band 128 when doing so. If the extension member 124 is attached to the right anchor 148*c*, then such setup exercises the right fibularis group (longus, brevis, tertius) and assisted by the tibialis anterior muscle when traversing the right foot 204 in the direction indicated by the elastic band 128 to create tension in the elastic band 128. If the extension member 124 is attached to anchor 148*d*, when using the right foot, that would activate or strengthen the right fibularis longus and brevis muscles primarily. If the extension member is left in 148*d*, but the patient uses the left foot, that would activate or strengthen the Tibialis posterior muscle primarily. And vice versa if the extension member 124 is attached to anchor 148*e*. If the extension member 124 is attached to anchor 148*e*, when using the right foot, the Tibialis posterior muscle would primarily be activated or strengthened, and when using the left foot, the fibularis longus and brevis muscles would primarily be active or strengthened.

The angular distance between the anchor holes 148*a* to 148*b* may be between 15 degrees to 60 degrees and is approximately 30-45 degrees typically. Additionally, the angular distance between the anchor holes 148*b* to 148*c* may be between 15 degrees 60 degrees and is approximately 30-45 degrees typically. The angular distance between the anchor holes 148*a* and 148*e* may be between 10-75 degrees, and is approximately 40-70 degrees typically. The angular distance between anchor holes 148 *c* and *d* may be between 10-75 degrees, and is approximately 40-70 degrees typically.

Referring now to FIG. 8, the short pedestal 166 may be substituted out for the long pedestal 168. The long pedestal 168 may be used in conjunction with the ankle strengthening exercise device when the patient 22 is seated in a chair, as shown in FIG. 8A. The base 112 of the device 110 is then laid on the floor in order to properly position the foot 204 of the patient 122 in the device 110. The long pedestal 168 may have five anchors 148*f*, 148*g*, 148*h*, 148*i* and 148*j*. The extension member 124 may be removably secured in any one of the anchors 148*f-j*, as shown in FIGS. 9-13. The anchor holes 148*g, h, i* may be angularly distanced apart from each other by 15-60 degrees, although approximately 35-45 degrees is typical. Additionally, the anchor holes 148*f*, 148*j* may be disposed or oriented between 120-180° apart from each other.

Figure 9:
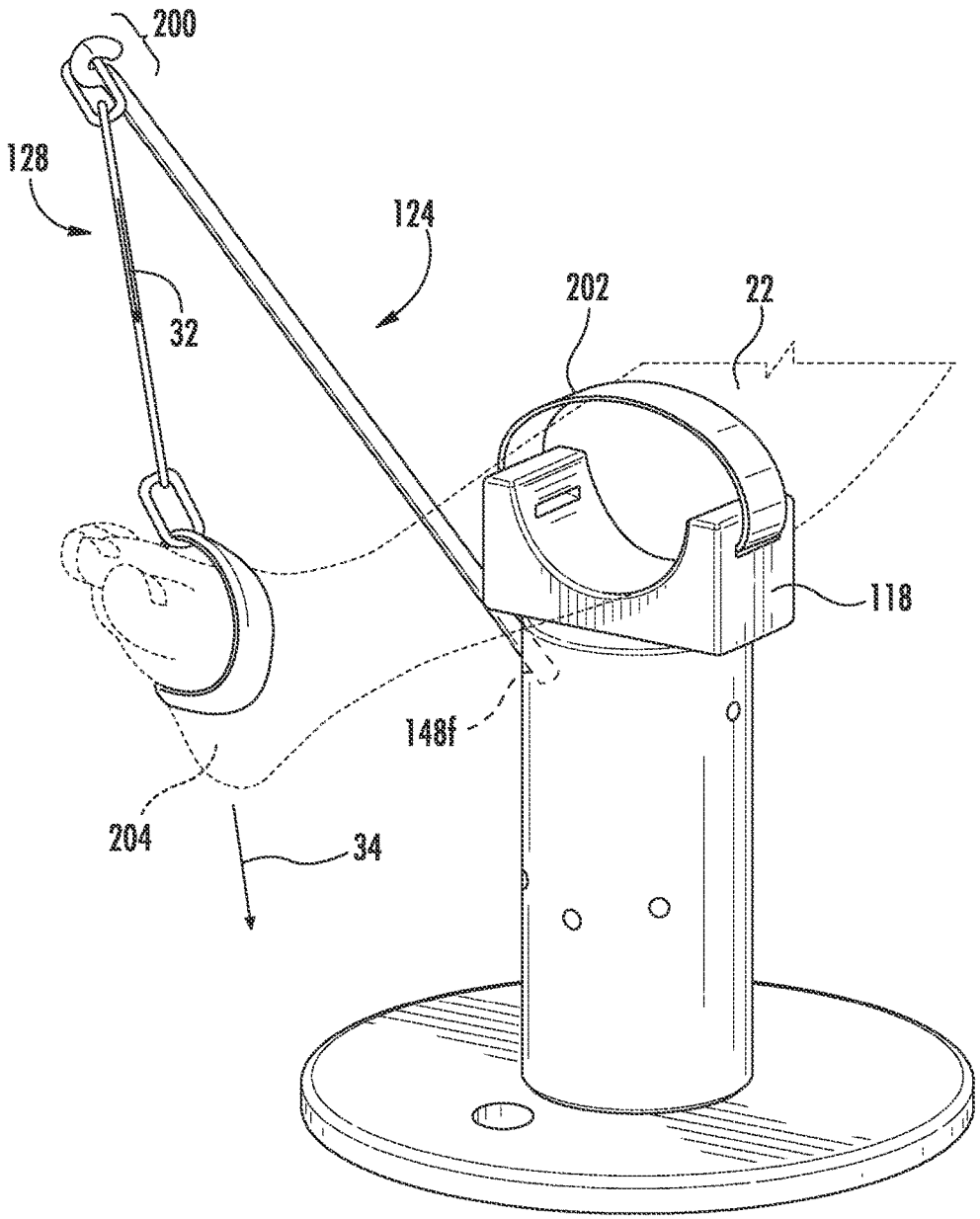
FIG. 9 illustrates the device shown in FIG. 7 with an extension member attached to one of a plurality of anchors.
Figure 10:
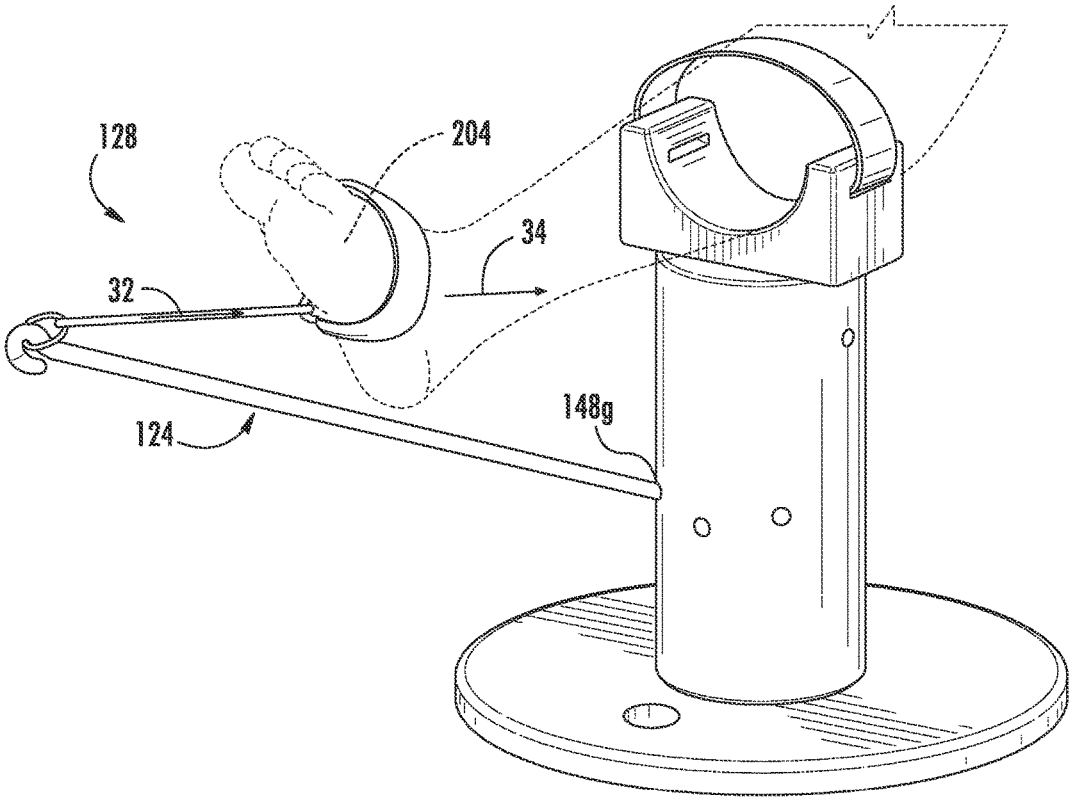
FIG. 10 illustrates the device shown in FIG. 7 with the extension member attached to another one of the plurality of anchors.

Referring now to FIG. 9, the extension member 124 is inserted into the anchor hole 148*f*. The lower leg of the patient 22 is laid in the cradle 118. The lower leg may be strapped in with strap 202. The distal portion 200 of the extension member 124 is positioned above the ankle/foot 204. The elastic band 128 is secured to the distal portion 200 of the extension member 124 and the foot. Various means of attaching the elastic band 128 to the distal portion 200 of the extension member 124 and the foot 204 are contemplated. By way of example and not limitation, the elastic band 128 may simply be tied to the foot 204 and the distal portion 200 of the extension member 124. Alternatively, the elastic band 128 may have loops 206 that are used to encircle the foot 204 and connect to a hook configuration of the distal portion 200 of the extension member 124. When the lower leg of the patient 22 is disposed in the cradle 118 and the elastic band 128 is attached to the distal portion 200 of the extension members 124 and the foot 204 of the patient 22, the elastic band 128 indicates a direction 32. The patient 22 is directed and should move the foot 204 in a direction 34 that is aligned to the direction 32 indicated by the elastic band 128. In doing so, this motion is considered ankle inversion with plantar flexion when the right leg is in the cradle 118, in order to properly activate and strengthen the right tibialis posterior muscle. However, if the left leg is in the cradle 118, it would then involve left ankle eversion with plantar flexion, in order to properly isolate and strengthen the fibularis longus and brevis. The device 110 presets or predetermines the direction 32 indicated by the elastic band 128 so that the direction activates or strengthens a particular muscle or group of muscles. Accordingly, in a clinical setting, less time is required from the physical therapist to train a patient how to properly perform the exercise at home, away from the clinic thereby reducing costs for the care provider and the patient.

Referring now the FIGS. 7 and 9-13, the extension member 124 may be placed in any one of the other anchors 148*f*, 148*g*, 148*h*, 148*i* and 148*j*. With each of the different positions shown in FIGS. 9-13, the elastic band 128 indicates a direction 32 in which the foot 204 should move 34. If the extension member 124 is attached to anchor 148*f* or 148*e*, then such setup will isolate and engage the tibialis posterior muscle when traversing the right foot in the direction indicated by the elastic band 128 to create greater tension in the elastic band 128. The same setup will isolate and engage the fibularis longus and fibularis brevis muscles when traversing the left foot in the direction indicated by the elastic band 128 to create greater tension in the elastic band 128. If the extension member 124 is attached to anchor 148*g* or 148*a*, then such setup will isolate and engage the fibularis longus, fibularis brevis and fiblaris tertius muscles when traversing the left foot 204 in the direction indicated by the elastic band 128 to create greater tension in the elastic band 128. If the extension member 124 is attached to anchor 148*h* or 148*b*, then such setup will isolate and engage the tibialis anterior when traversing either right or left foot 204 in the direction indicated by the elastic band 128 to create greater tension in the elastic band 128. If the extension member 124 is attached to anchor 148*i* or 148*c*, then such setup will isolate and engage the fibularis longus, fibularis brevis and fibularis tertius muscles when traversing the right foot 204 in the direction indicated by the elastic band 128 to create greater tension in the elastic band 128. If the extension member 124 is attached to anchor 148*j* or 148*d*, then such setup will isolate and engage the fibularis longus and fibularis brevis muscles when traversing the right foot 204 in the direction indicated by the elastic band 128 to create greater tension in the elastic band 128. The same setup will isolate and engage the tibialis posterior muscle when traversing the left foot in the direction indicated by the elastic band 128 to create greater tension in the elastic band 128.

Figure 14:
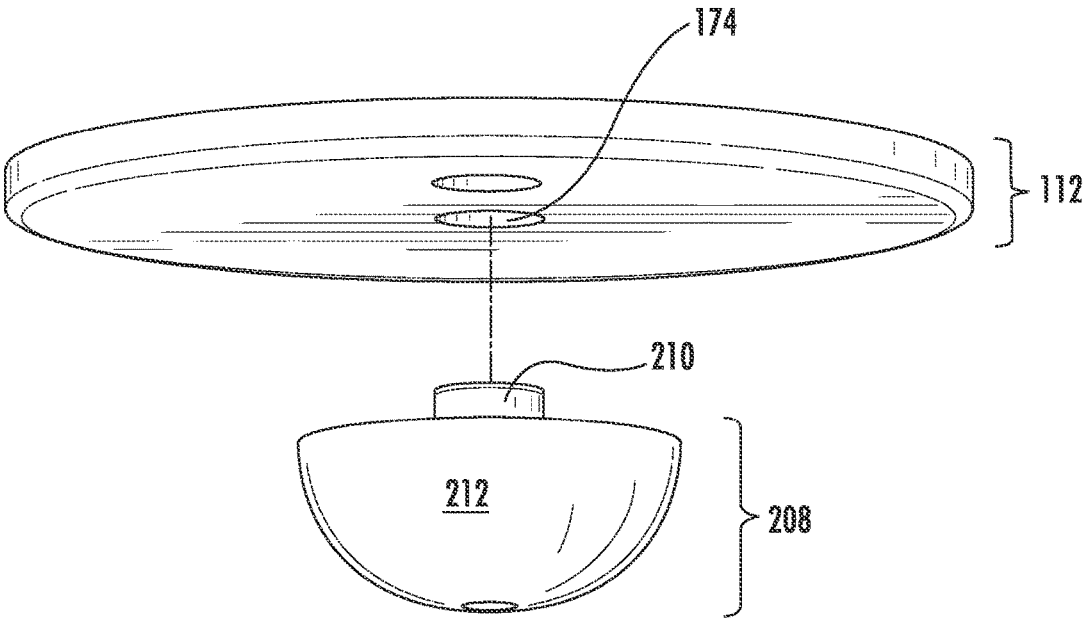
FIG. 14 illustrates the device shown in FIG. 7 or 8 being converted to a proprioception board.
Figure 16:
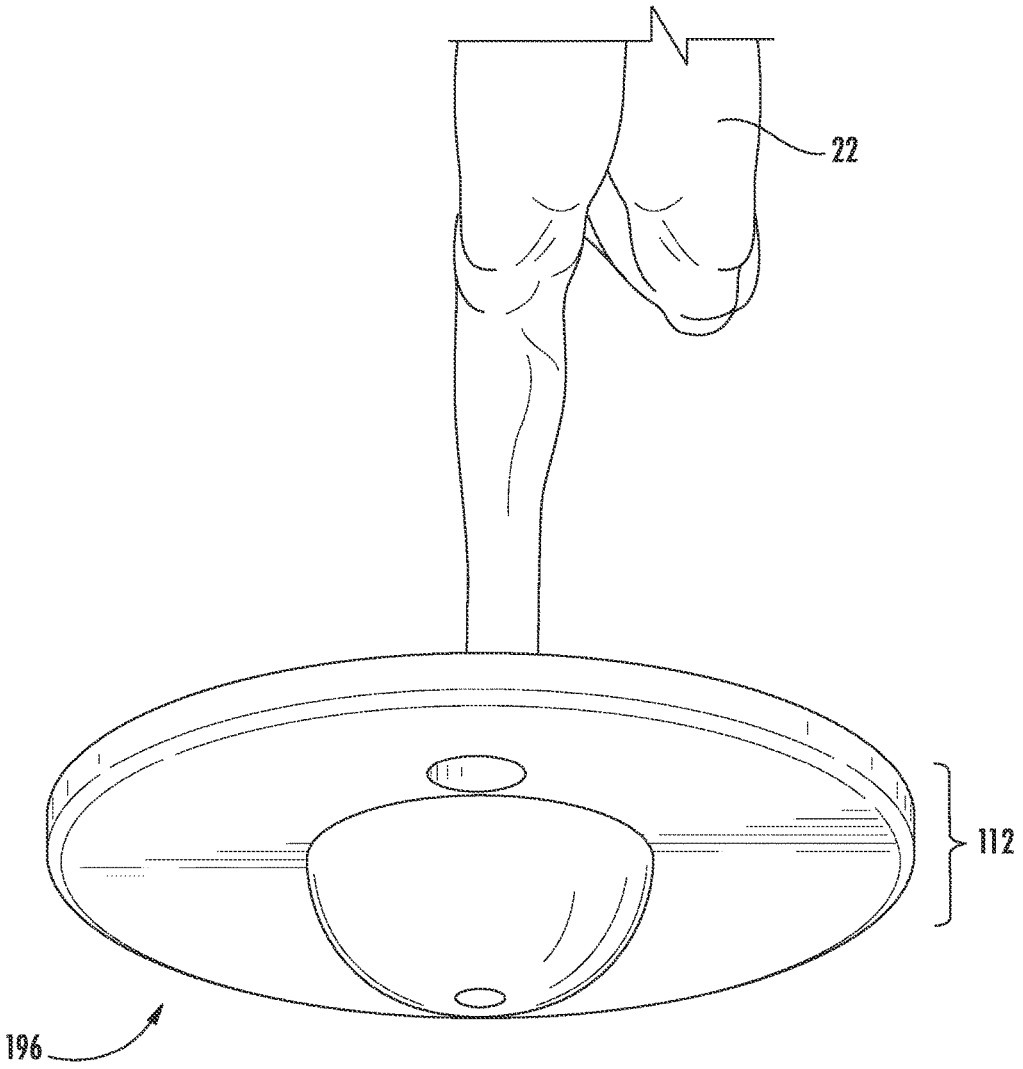
FIG. 16 illustrates the device shown in FIG. 14 being used as a proprioception board with one foot planted on the board.

Referring now to FIGS. 14-16, the ankle strengthening exercise device 110 may also be converted to a balance board 196 for proprioception training. To convert the ankle strengthening device 110 to the balance board 196, a bulbous (e.g., hemispherical) member 208 may have a protrusion 210 that is received into the center recess 174 (see FIG. 8) of the base 112. The bulbous member 208 may have a round exterior surface 212 which forces the user 22 to balance him or herself on the ground when the user 22 stands on the opposite side as shown in FIG. 15. The protrusion 210 and the recess 174 may have a detent to prevent the bulbous member 208 from inadvertently dislodging from the base 112 during use. Additionally, the protrusion 210 and the recess 174 may have mating threading that prevents the bulbous member 208 from inadvertently dislodging from base 112 during use. Alternatively, the ankle strengthening exercise device 110 may also be help with other proprioception training exercises by attaching the protrusion 210 of the bulbous member 208 to the recess 182 (see FIG. 7) of the base 112.

The various components of the device are connected to each other with a hole/peg configuration. However, it is also contemplated that the components may be connected to each other with a reverse configuration, namely, a peg/hole configuration. Moreover, the device 110 has been described in relation to a plurality of components which are assembled into the device. However, it is also contemplated that the cradle 118, pedestal 166, 168 and the base 112 may be fabricated from a unitary material.

Referring now to FIGS. 17-20, tests were conducted to determine whether the devices 10, 110 effectively activated a desire muscle or muscle group when a person traversed his/her foot in a direction 34 visually indicated by an elastic band 28, 128. For the tests, the device 110 was arranged into various configurations as shown in FIGS. 9-13. A person or test subject was seated in a chair with his right leg extended and positioned in the cradle 118. Electrodes were placed on two muscles or groups of muscles to detect and record an electromyography (i.e., EMG) signal. A first muscle or muscle group was a target muscle or muscle group, which is the muscle or muscle group intended to be strengthened. A second muscle or muscle group was a control muscle or muscle group which is a muscle or muscle group not intended to be strengthened. The upper graphs shown in FIGS. 17-20 show the EMG signal detected for the control muscle or muscle group and establishes a baseline EMG signal. The lower graphs shown in FIGS. 17-20 show the EMG reading for the target muscle or muscle group. The X-axis depicts units of time with the peaks showing the EMG reading as the person traversed his/her foot in the direction visually indicated by the elastic band 128. The Y-axis depicts motor units expressed as microvolts (μV).

Figure 11:
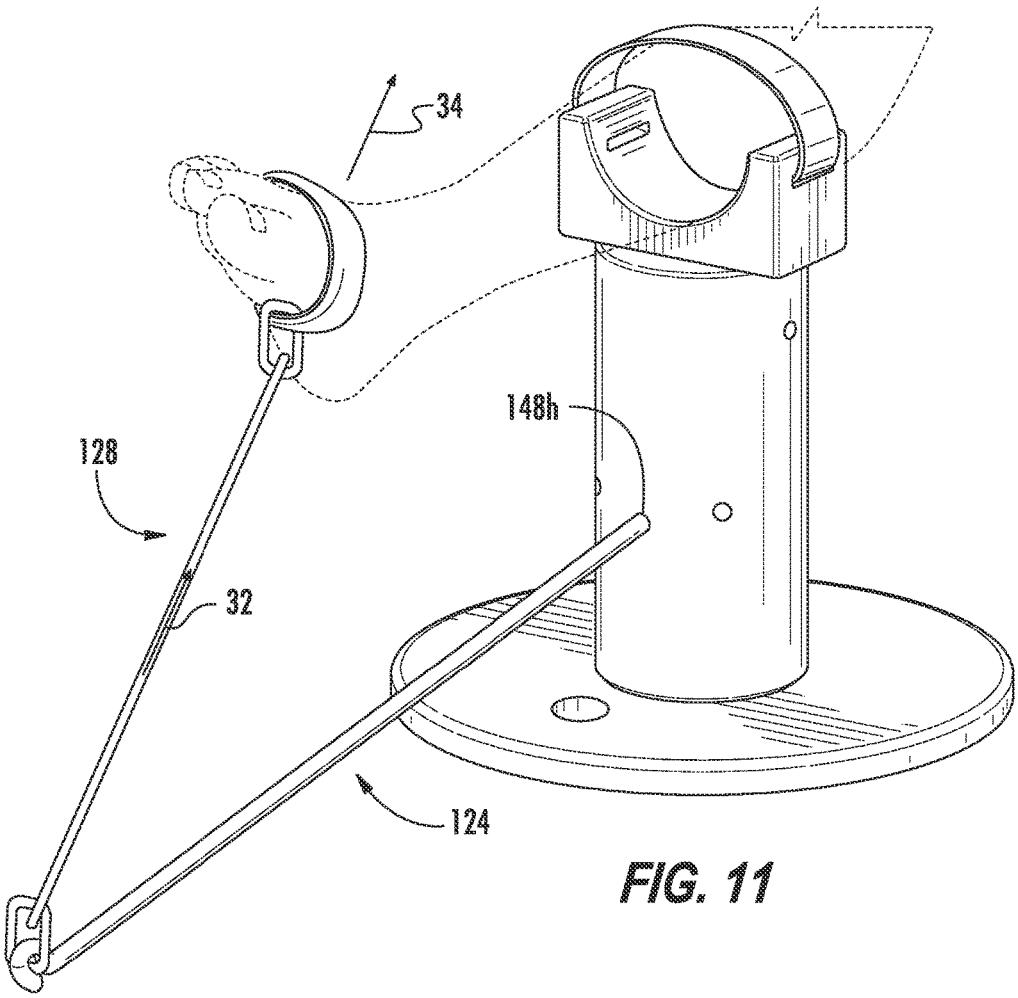
FIG. 11 illustrates the device shown in FIG. 7 with the extension member attached to another one of the plurality of anchors.
Figure 17:
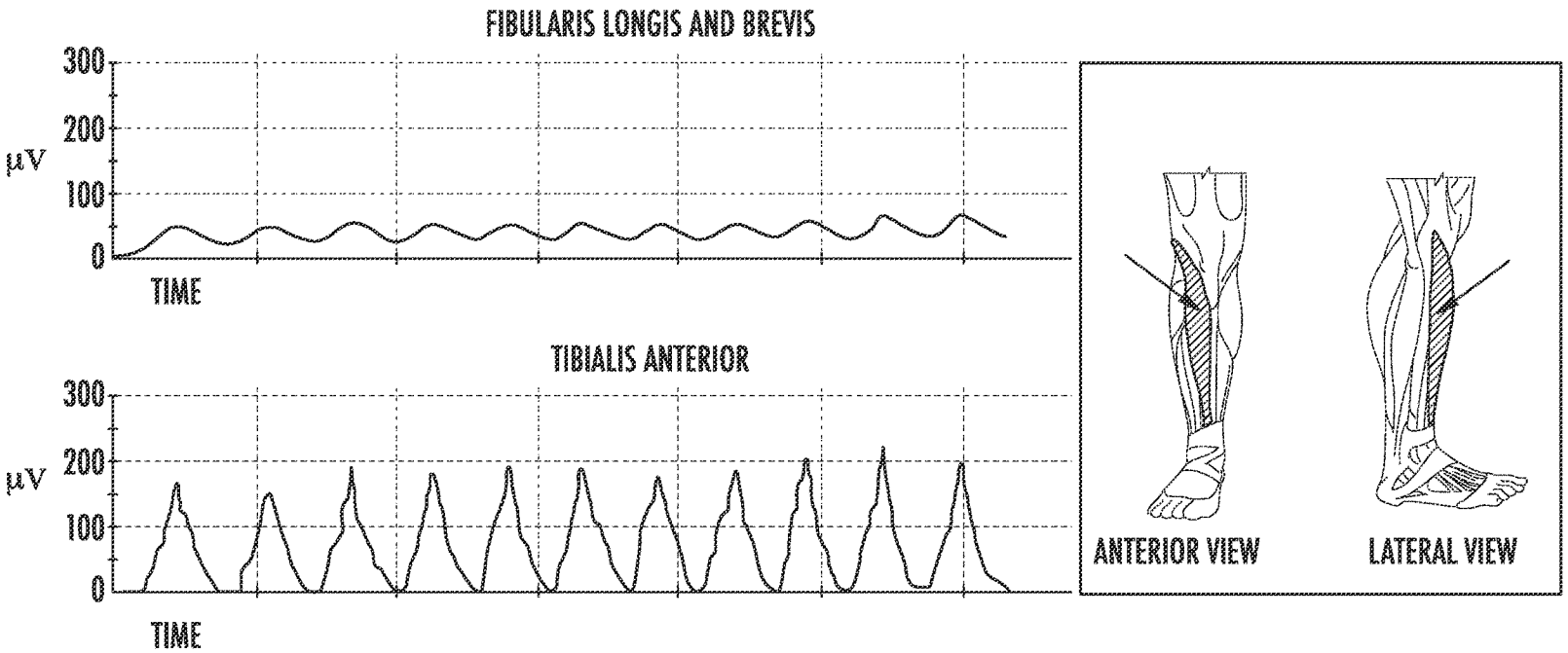
FIG. 17 illustrates results of a first test to determine effectiveness of isolating a first target muscle or muscle group for strengthening.

In FIG. 17, the control muscles were the Fibularis Longus and Fibularis Brevis muscles. The target muscle was the Tibialis Anterior as shown by the arrows on the anatomical diagram of the lower leg. The device 110 was arranged as shown in FIG. 11. The person's right leg was placed on the cradle 118. An elastic band was attached to the person's right foot and the distal end portion 200 of the extension member 124. The person was directed to traverse his right foot visually indicated by the elastic band 128 (i.e., dorsiflexion). The EMG readings for the control muscles and the target muscle are shown in FIG. 17.

Figure 12:
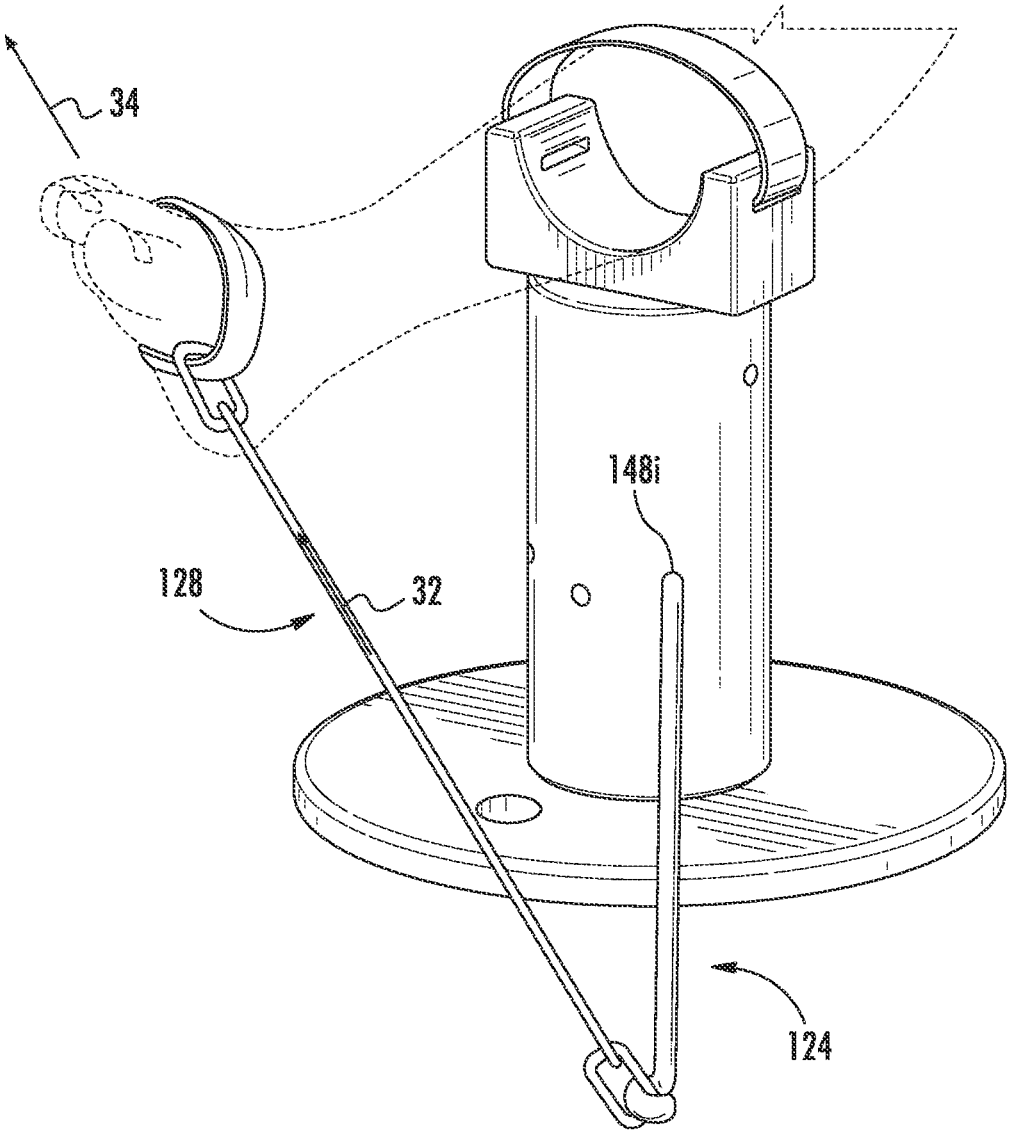
FIG. 12 illustrates the device shown in FIG. 7 with the extension member attached to one of the plurality of anchors.
Figure 18:
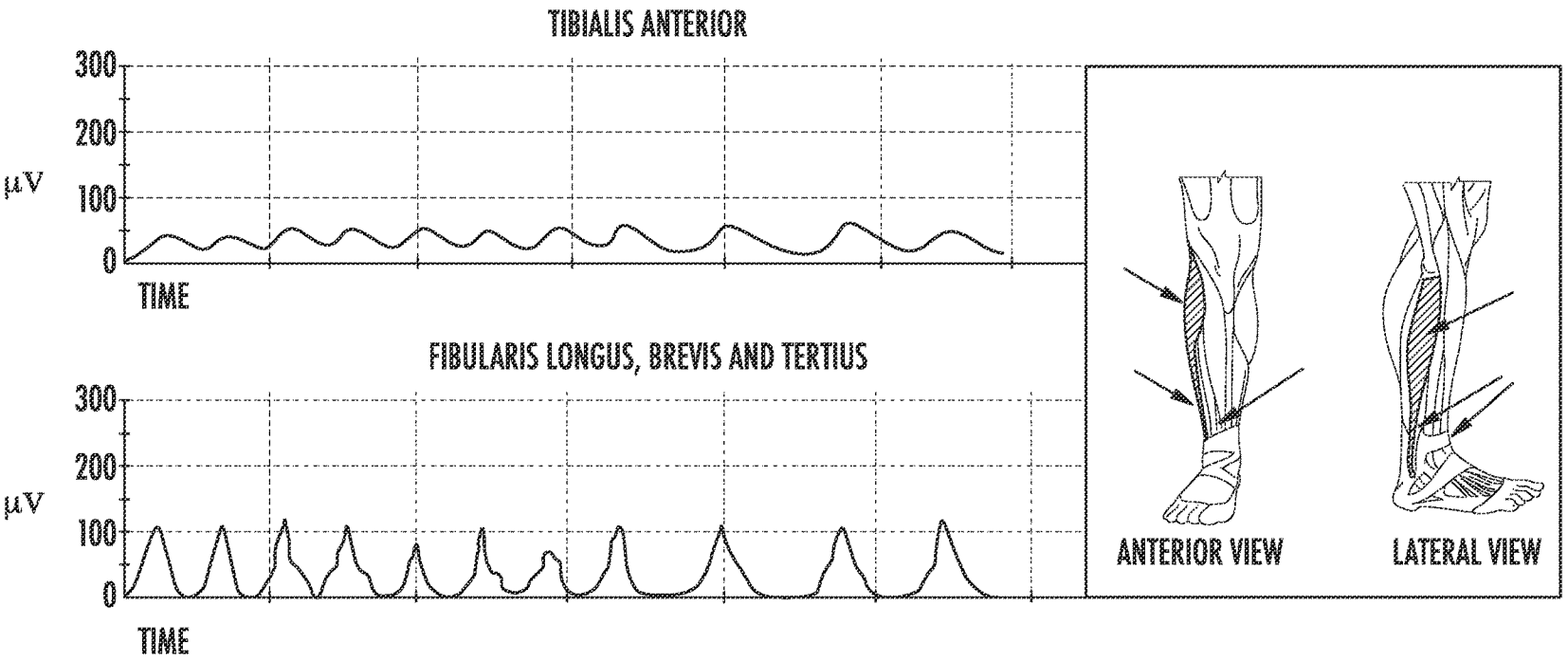
FIG. 18 illustrates results of a second test to determine effectiveness of isolating a second target muscle or muscle group for strengthening.

In FIG. 18, the control muscle was the Tibialis Anterior muscle. The target muscle group included the Fibularis Longus, Fibularis Brevis and Fibularis Tertius muscles as shown by the arrows on the anatomical diagram of the lower leg. The device 110 was arranged as shown in FIG. 12. The person's right leg was placed on the cradle 118. An elastic band was attached to the person's right foot and the distal end portion 200 of the extension member 124. The person was directed to traverse his right foot visually indicated by the elastic band 128 (i.e., dorsiflexion with eversion). The EMG readings for the control muscle and the target muscles are shown in FIG. 18.

Figure 13:
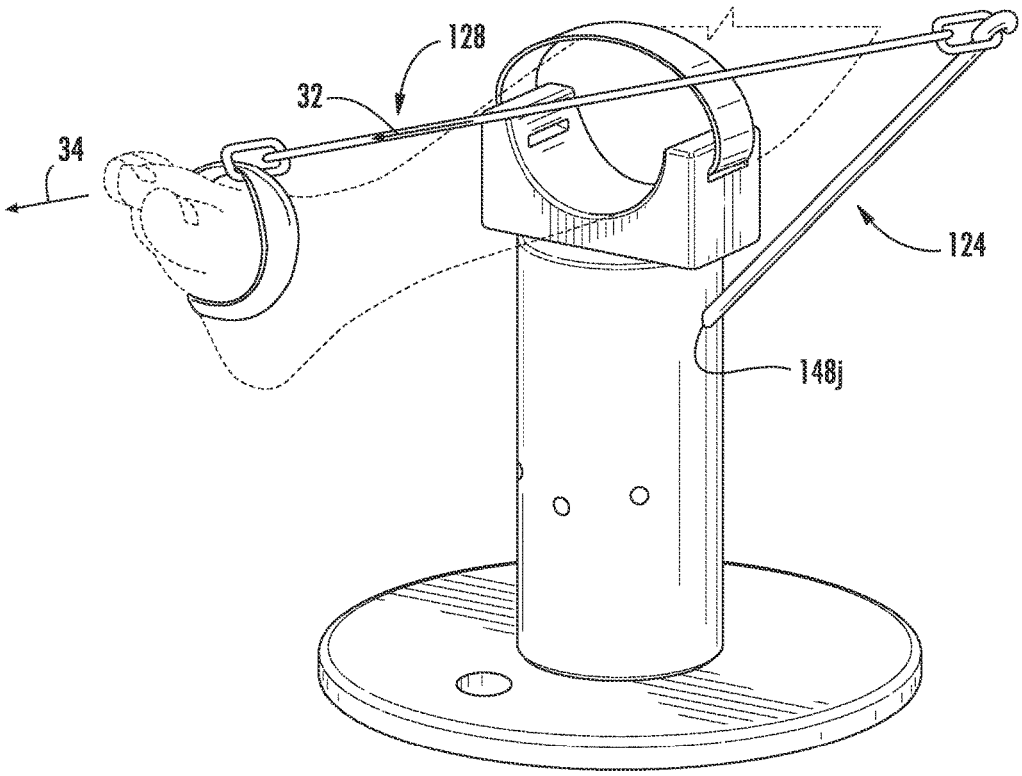
FIG. 13 illustrates the device shown in FIG. 7 with the extension member attached to one of the plurality of anchors.
Figure 19:
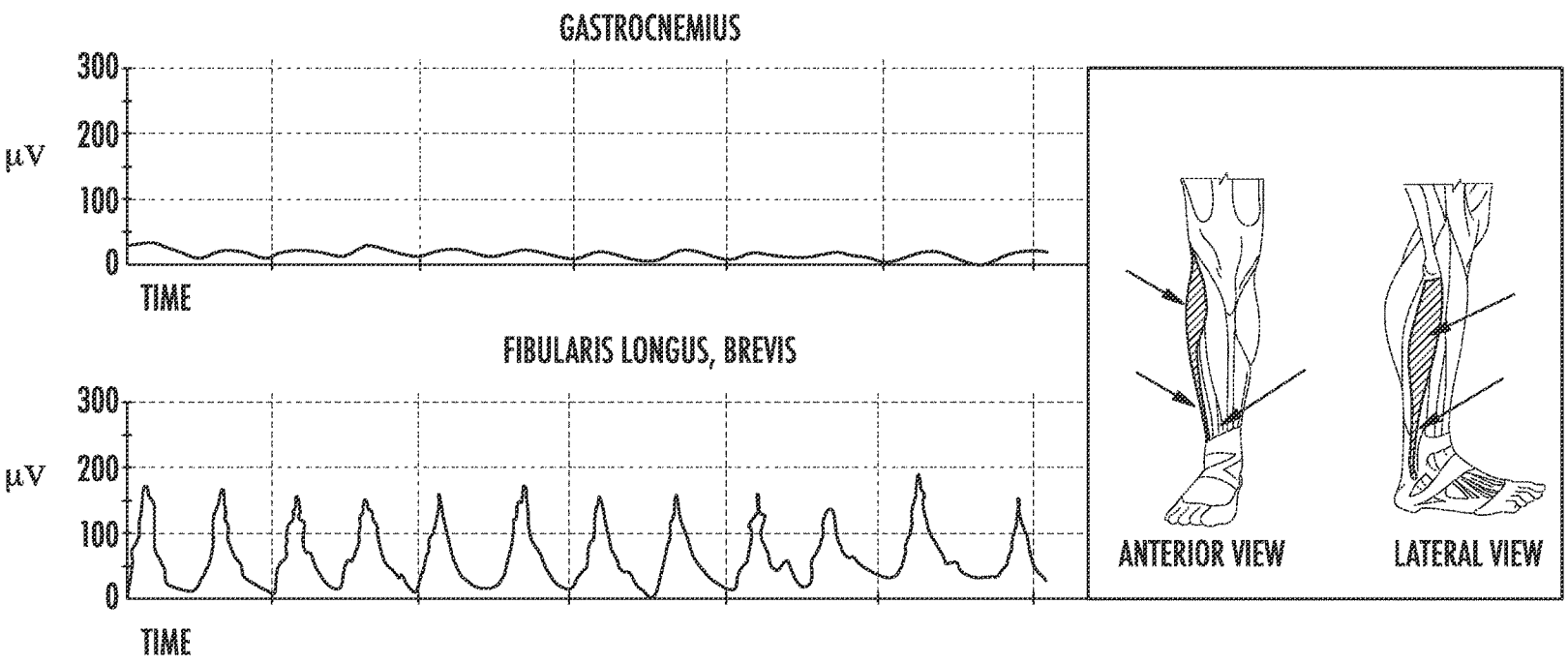
FIG. 19 illustrates results of a third test to determine effectiveness of isolating a third target muscle or muscle group for strengthening.

In FIG. 19, the control muscle was the Gastrocnemius muscle. The target muscle were the Fibularis Longus and Fibularis Brevis muscles as shown by the arrows on the anatomical diagram of the lower leg. The device 110 was arranged as shown in FIG. 13. The person's right leg was placed on the cradle 118. An elastic band was attached to the person's right foot and the distal end portion 200 of the extension member 124. The person was directed to traverse his right foot visually indicated by the elastic band 128 (i.e., eversion with plantar flexion). The EMG readings for the control muscle and the target muscles are shown in FIG. 19.

Figure 20:
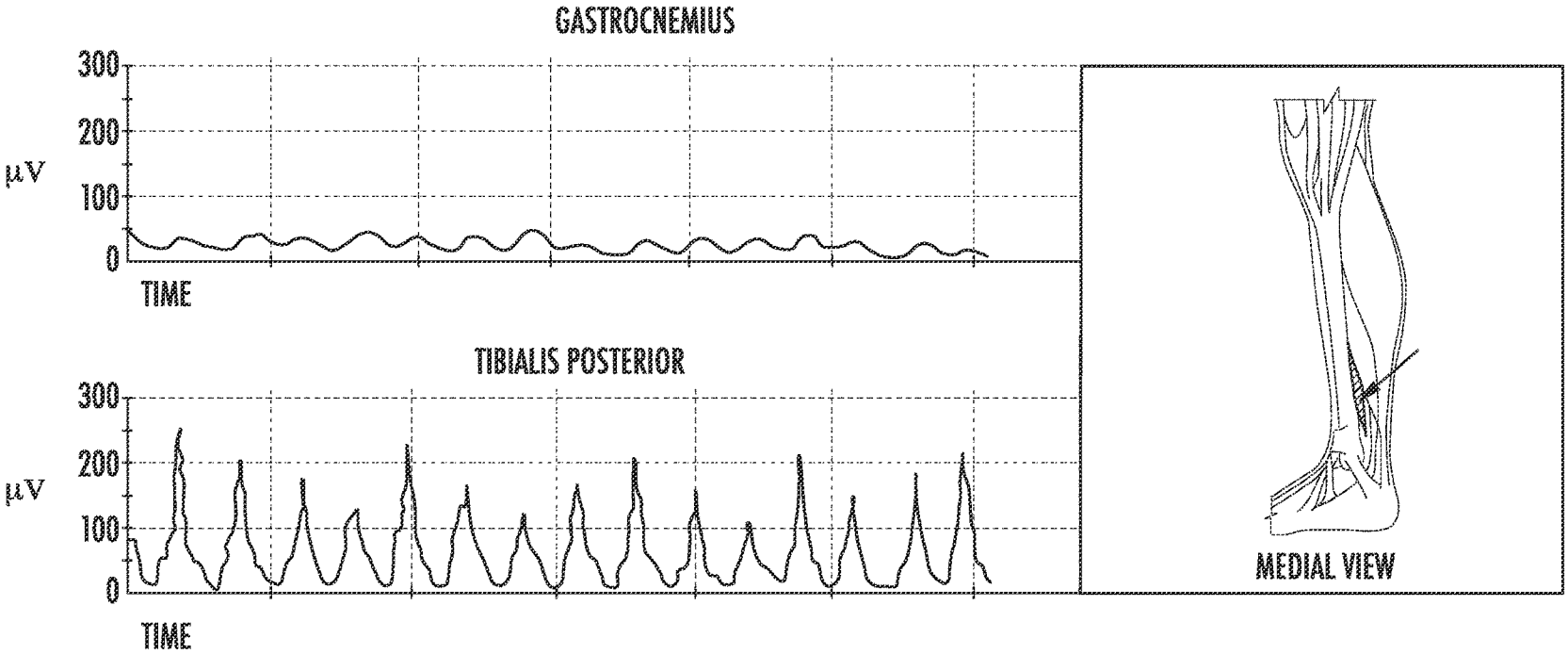
FIG. 20 illustrates results of a fourth test to determine effectiveness of isolating a fourth target muscle or muscle group for strengthening.

In FIG. 20, the control muscle was the Gastrocnemius muscle. The target muscle was the Tibialis Posterior muscle as shown by the arrows on the anatomical diagram of the lower leg. The device 110 was arranged as shown in FIG. 9. The person's right leg was placed on the cradle 118. An elastic band was attached to the person's right foot and the distal end portion 200 of the extension member 124. The person was directed to traverse his right foot visually indicated by the elastic band 128 (i.e., inversion with plantar flexion). The EMG readings for the control muscle and the target muscle are shown in FIG. 20.

The data in FIGS. 17-20 demonstrates that traversing the foot in the visually indicated direction of the elastic band 128 by pivoting around the ankle effectively isolates the target muscle or muscle group. Although the tests were completed with the device 110, it is believed that the device 10 would result in the same results.

The above description is given by way of example, and not limitation. Given the above disclosure, one skilled in the art could devise variations that are within the scope and spirit of the invention disclosed herein, including various ways of forming the anchor or fixation point. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An ankle strengthening exercise device for strengthening one or more muscles associated with an ankle, the device, comprising:

a frame including a base for supporting the device during use, a pedestal attached to the base and a leg cradle positioned atop the pedestal, wherein the pedestal positions a leg of a person at a height;

an elongate extension member securable to a hole positioned on the pedestal of the frame so that a distal end portion of the elongate extension member is positioned laterally, at a skewed angle or in front of the ankle; and an elastic member defining first and second opposed end portions, the first end portion being securable to a foot of a person and the second end portion being securable to the distal end portion of the elongate extension member;

wherein a direction of the elastic member indicates a direction of the foot of a person to be moved by pivoting the ankle of the person to exercise and strengthen the one or more muscles associated with the ankle.

2. The device of claim 1 wherein the elongate extension member is straight or S shaped.

3. The device of claim 1 further comprising a plurality of elongate extension members, each elongate extension member being a different length and/or shape.

4. The device of claim 1 wherein the pedestal is removably securable to the base.

5. The device of claim 1 therein the pedestal can be removed from the base and replaced with a bulbous member to convert the ankle strengthening device into a proprioception training device.

6. The device of claim 5 wherein the proprioception training device is a balance board.

7. The device of claim 1 wherein the frame has a plurality of holes positioned on the pedestal of the frame.

8. The device of claim 7 wherein the plurality of holes are angularly spaced apart between about 15 degrees to 180 degrees.

9. The device of claim 7 wherein the plurality of holes are oriented so as to position the elongate extension member horizontal to the base attached to the pedestal.

10. The device of claim 7 wherein the plurality of holes are oriented so as to position the elongate extension member angled downward toward the base attached to the pedestal.

11. The device of claim 7 wherein the plurality of holes are oriented so as to position the elongate extension member angled upward away from the base attached to the pedestal.

12. An ankle strengthening exercise device for strengthening one or more muscles associated with an ankle, the device comprising:

a leg cradle adapted to directly contact a calf of the leg so that a foot of the leg is free to move linearly, the leg cradle atop a pedestal to position the leg cradle at a height, the pedestal attached to a base which supports the device during use;

an anchor positioned on the pedestal;

an elongate extension member securable to the anchor so that a distal end portion of the elongate extension member is positioned laterally, at a skewed angle or in front of the ankle when the leg cradle supports the leg at or above the ankle and below the knee; and a single elastic member defining first and second opposed end portions, the first end portion being adapted to be directly securable to a person's foot and the second end portion being securable to the distal end portion of the elongate extension member;

wherein a length of the elastic member indicates a single direction of linear movement of the foot of the person to be made to exercise and strengthen one or more muscles of the person's ankle so that the single elastic member primarily moves along the single direction during movement of the foot and rotation of the ankle.

13. The device of claim 12 further comprising a cuff or band attached to the first end portion of the single elongate elastic member, and the cuff or band is wrapped around the person's foot for directly securing the first end portion of the single elongate elastic member to the person's foot.

14. The device of claim 12 wherein the first end portion of the single elongate elastic member is tied around the person's foot for directly securing the first end portion of the single elongate elastic member to the person's foot.

15. A method of utilizing an ankle strengthening device to exercise and strengthen a muscle associated with an ankle of a person, the method comprising the steps of:

providing an elongate extension member capable of being securable to a hole positioned on a pedestal of a frame attached to a leg cradle, the leg cradle being adapted to directly contact a calf of the person so that a foot of the person is free to move linearly, the leg cradle positioned atop the pedestal of a frame and the pedestal is attached to a base which supports the device during use, wherein the pedestal positions the leg cradle to a height;

securing the elongate extension member to the hole so that a distal end portion of the elongate extension member is positioned laterally, at a skewed angle or in front of the ankle of the person;

securing a single elongate elastic member to the distal end portion of the elongate extension member and directly to a foot of the person to provide resistance during an ankle exercise and indicate a single direction of linear foot movement during the ankle exercise;

resting a calf of the person's leg directly on the leg cradle so that the leg cradle directly contacts the calf of the person's leg for facilitating linear movement of the foot; and linearly traversing the foot in the single direction indicated by a direction of a length of the single elongate elastic member so that the single elongate elastic member primarily moves along the single direction.

16. The method of claim 15 wherein the elongate extension member is securable to any one of a plurality of holes positioned on the pedestal of the frame.

17. The method of claim 16 further comprising a step of recording a vertical position of the leg cradle, an angular orientation of the leg cradle, the hole securing the elongate extension member from a plurality of holes to which the elongate extension member is to be secured.

18. A method of exercising and strengthening a muscle associated with an ankle, the method comprising the steps of:

providing a leg cradle configured to directly contact a calf of a person, the leg cradle being a part of an ankle exercise device, and an elongate extension member securable to an anchor positioned on a pedestal of a frame attached to the leg cradle of the ankle exercise device, the leg cradle positioned atop the pedestal of a frame and the pedestal is attached to abase which supports the device during use, wherein the pedestal positions the leg cradle to a height;

securing the elongate extension member to the anchor to position a distal end portion of the elongate extension member in front of a foot of a person;

securing a single elongate elastic member to the elongate extension member and directly to the foot of the person to provide resistance during an ankle exercise and a length of the single elongate elastic member indicates a single direction of linear foot movement during the ankle exercise; and linearly moving the foot in the single direction indicated by a length of the single elongate elastic member so that the single elongate elastic member primarily moves along the single direction.

19. The method of claim 18 wherein the step of securing the single elongate elastic member directly to the foot of the person comprises the step of:

attaching a cuff or band to the first end portion of the single elongate elastic member and wrapping the cuff or band around the person's foot.

20. The method of claim 18 wherein the step of securing the single elongate elastic member directly to the foot of the person comprises the step of:

tying the first end portion of the single elongate elastic member around the person's foot.

* * * * *